United States Patent [19]

Hasebe et al.

[11] Patent Number: 4,820,624

[45] Date of Patent: Apr. 11, 1989

[54] CORNER DEVELOPMENT TYPE SILVER HALIDE PHOTOGRAPHIC EMULSIONS

[75] Inventors: Kazunori Hasebe; Masahiro Asami; Naoto Ohshima; Keisuke Shiba; Toshihiro Nishikawa, all of Kanagawa, Japan

[73] Assignee: Fuji Photo Film Co., Ltd., Kanagawa, Japan

[21] Appl. No.: 138,405

[22] Filed: Dec. 28, 1987

[30] Foreign Application Priority Data

Dec. 26, 1986 [JP] Japan ..... 61-311131
Apr. 8, 1987 [JP] Japan ..... 62-86163

[51] Int. Cl.[4] ..... G03C 1/02; G03C 1/12; G03C 1/19

[52] U.S. Cl. ..... 430/567; 430/569; 430/570; 430/572; 430/574; 430/576; 430/577; 430/581

[58] Field of Search ..... 430/567, 569, 570, 572, 430/574, 576, 577, 581

[56] References Cited

U.S. PATENT DOCUMENTS 3,864,134 2/1975 Ueda et al. ..... 430/574
3,865,598 2/1975 Shiba et al. ..... 430/550
4,495,277 1/1985 Becker et al. ..... 430/567
4,564,591 1/1986 Tanaka et al. ..... 430/567
4,605,610 8/1986 Klözer ..... 430/603

*Primary Examiner*—Mukund J. Shah
*Attorney, Agent, or Firm*—Sughrue, Mion, Zinn, Macpeak, and Seas

[57] ABSTRACT

A corner development type silver halide photographic emulsion is disclosed, wherein the silver halide crystals in the silver halide emulsion are cubic or tetradecahedral grains having at least substantial (100) planes and the emulsion is controlled so that at least 70% of developed silver halide crystals (grains), which are observed on applying a light exposure of 1/50 second to the emulsion under the light-exposure condition corresponding to (maximum density —minimum density)$\times\frac{3}{4}$ of the silver image in the characteristic curve of the emulsion obtained by the developer, developing under the development condition which are used for processing a photographic light-sensitive material formed by coating the emulsion on a support, and stopping the development with an aqueous solution of 5% glacial acetic acid just after the initiation of the development, are developed at the corners of the cubic or tetradecahedral crystals or at the vicinity of the corners.

13 Claims, 2 Drawing Sheets

CORNER DEVELOPMENT TYPE SILVER HALIDE PHOTOGRAPHIC EMULSIONS

FIELD OF THE INVENTION

This invention relates to novel silver halide photographic emulsions. More particularly, the invention relates to high-speed and stable silver halide photographic materials using the above-described silver halide emulsions and capable of being quickly processed, and even more particularly to high-speed and stable color photographic materials mainly using a light-sensitive silver chloride or silver chlorobromide emulsion and providing high utilization efficiency of silver halide.

BACKGROUND OF THE INVENTION

With the increasing growth of color photographic light-sensitive materials, color processing of color photographic materials is more and more simplified and quickened. On the other hand, high quality color images and uniformity of finished image quality have been required. It is known that a silver iodobromide emulsion containing from 4 to 20 mol% silver iodide is generally used for photographing color photographic materials and a silver chlorobromide emulsion is generally used for color photographic papers for printing. It is also known that a silver chlorobromide is reluctant to give images having high quality at high speed as compared to a silver iodobromide emulsion.

Silver chlorides or silver chlorobromide of, in particular, cubic grains having a (100) crystal plane are very useful for rapid simple processing. However, they have the disadvantages that the sensitivity thereof is low, chemical sensitization and spectral sensitization are not easily achieved, the sensitivity obtained is unsuitable, and the silver halide grains have a tendency to produce fog.

Various methods for solving these problems have been proposed. For example, a method of adding water-soluble bromide ions or iodide ions to the silver halide emulsion after adding sensitizing dye(s) thereto is described in Japanese Patent Application (OPI) No. 51627/73 (The term "OPI" as used herein means an "unexamined published application".), Japanese Patent Publication No. 46932/74, etc.; a method of simultaneously adding bromide ions and silver ions to silver halide grains having a high content of silver chloride to form a silver bromide region of more than 60 mol% on the surface of the grains or of similarly forming a layer of 10 mol% to 50 mol% silver bromide on the surfaces of the grains is described in Japanese Patent Application (OPI) Nos. 108533/83, 222845/85, etc.; and a method of adding bromide ions or simultaneously adding bromide ions and silver ions to silver halide grains having a high content of silver chloride to form, thus, multiphase structure grains such as double layer grains or junction structure grains is described in Japanese Patent Publication Nos. 36978/75, 240772/83, U.S. Pat. No. 4,471,050, West German patent application (OLS) No. 3,229,999, etc.

However, all of the aforesaid methods have been found to have various defects in terms of sensitivity and have stability thereof, in particular, a reduction in sensitivity by the addition of color couplers to the silver halide grains, and on the tightness of gradation at shadow portions. Also, it is known that these silver halide emulsions are unstable and thus the production thereof is difficult. This matter is described, for example, in Zuckerman *Journal of Photographic Science*, 24, 142 (1976), etc.

SUMMARY OF THE INVENTION

A first object of this invention is to provide a color photographic light-sensitive emulsion having high speed and stably giving processed products having improved uniformity using a silver chloride or silver chlorobromide emulsion useful for quick and simple processing.

A second object of this invention is to provide a color photographic light-sensitive emulsion giving good tightness of shadow portions and having high utilization efficiency of silver halide, whereby the coating amount of silver may be less.

Other objects of this invention will become apparent from the descriptions of this invention as set forth hereinbelow.

As the result of various investigations, it has now been discovered that the above-described objects can be effectively attained by a corner development type silver halide photographic emulsion wherein the silver halide crystals in the silver halide emulsion are cubic or tetradecahedral grains having at least substantial (100) planes and the emulsion is controlled so that at least 70 wt% of developed silver halide crystals (grains) observed on applying a light exposure of 1/50 second to the emulsion under the light-exposure condition corresponding to (maximum density − minimum density) $\times \frac{3}{4}$ of the silver image in the characteristic curve of the emulsion obtained by the developer and the development condition which are used for processing a photographic light-sensitive material formed by coating the emulsion on a support and after the initiation of the development, stopping the development with an aqueous solution of 5% glacial acetic acid are developed at the corners of the cubic or tetradecahedral crystals or at the vicinity of the corners.

The CDG emulsion used in this invention is a silver halide emulsion, wherein the silver halide crystals are cubic or tetradecahedral grains having at least substantial (100) planes and the emulsion is controlled so that at least 70% of the developed silver halide crystals (grains) observed in the case of applying a light exposure of 1/50 second to the emulsion under a light exposure condition corresponding to (maximum density − minimum density) $\times \frac{3}{4}$ of the silver image in the characteristic curve of the emulsion obtained by the developer and developing under the development condition which are used for processing the above-described photographic material, and just after initiation of the development, quickly stopping the development with an aqueous solution of 5% glacial acetic acid are developed at one or more corners of the vicinity of the cubic or tetradecahedral crystals or at the vicinity of at least one of the corners.

DETAILED DESCRIPTION OF THE INVENTION

Figure 1:
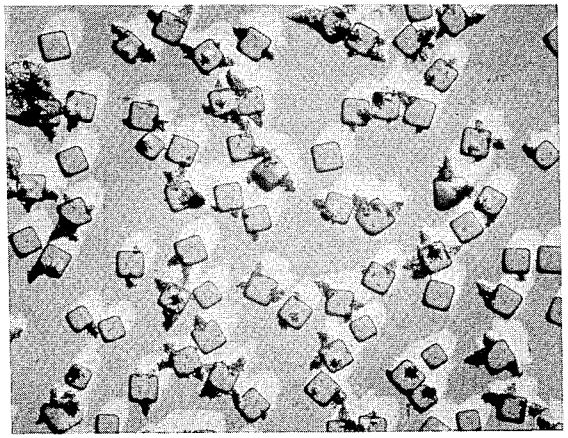
FIG. 1 is an electron microphotograph (5,000 degree of magnification) showing the silver halide crystals of Emulsion (A) prepared in Experiment (1) described below at the beginning of development.

Whether or not a cubic grain or tetradecahedral grain silver halide emulsion corresponds to the CDG emulsion of this invention may be determined by the method described above and more specifically, it can be determined by the following method.

That is, a silver halide emulsion is coated on a support at a silver amount of from 0.5 g/m$^2$ to 3 g/m$^2$ to produce a light-sensitive material, a uniform light-exposure of 1/50 second is applied to this light-sensitive material under a light-exposure condition corresponding to (maximum density − minimum density) × $\frac{3}{4}$ of the silver image in the characteristic curve obtained by developing the photographic material using a developer having the composition described below at 30° C., and after developing the photographic material with the same developer for 10 seconds at 30° C., the development is stopped with an aqueous solution of 5% by wt glacial acetic acid.

The silver halide grains developed at the corners of the cubic or tetrahedral crystals or at the vicinity of the corners in this case are called "Corner Development Grains" (CDG).

In this case, whether or not silver halide grains are developed can be seen by separating silver halide grains form the silver halide emulsion in a conventional manner and observing the blackened developed silver. The details of this method are further described below in Experiment (1).

Also, when in a silver halide emulsion, at least 70% of the silver halide grains thus developed are developed at the corners of the cubic or tetradecahedral crystals or at the vicinity of the corners, the emulsion corresponds to the CDG emulsion of this invention.

The ratio of the grains is determied by observing 200 numbers of developed silver grains through electlon microscope, and calculating.

The term "the vicinity of the corners" as used herein means the area is within the area of a regular square having a side length of about $\frac{1}{3}$, preferably 1/5, of the diameter of a circle having the same area as the projected area of the cubic or tetradecahedral grain and having a corner of the square at the corner of the grain.

| Developer Composition | |
|---|---|
| Triethanolamine | 8 ml |
| N,N—Diethylhydroxylamine (85% by wt, aqueous solution) | 5 ml |
| Ethylenediaminetetraacetic Acid. 2Na.2$H_2O$ | 2.2 g |
| N—Ethyl-N—(β-methanesulfonamido-ethyl)-3-methyl-4-aminoaniline Sulfate | 5.0 g |
| Sodium Sulfite | 0.13 g |
| Sodium Chloride | 1.4 g |
| Potassium Hydrogen Carbonate | 5 g |
| Potassium Carbonate | 18 g |
| Water to make | 1,000 ml |

It is preferred that in the aforesaid method of determination for the CDG emulsion, at least 70 wt%, more preferably at least 80 wt%, of the developed silver halide grains in the case of applying a light exposure of 1/50 second to a silver halide emulsion, developing the emulsion under the above-described condition, and stopping the development are developed at the corners of the cubic or tetradecahedral crystals or at the vicinity of the corners.

The CDG emulsion for use in this invention can be preferably prepared by the following manner.

(1) The host silver halide crystals which are used for preparing the CDG emulsion of this invention are cubic or tetradecahedral crystal grains (which may have roundish corners and higher order planes) substantially having a (100) plane, the halogen composition thereof is silver bromide, silver chlorobromide, or silver chloride containing no silver iodide or 2 mol% or less silver iodide, and the host grains are preferably silver halide crystals containing at least 5 mol% silver chloride, more preferably silver halide crystals containing at least 80 mol% silver chloride, and particularly preferably silver halide crystals containing at least 99 mol% silver chloride or pure silver chloride crystals. The mean grain size of the host silver halide grains is preferably from 0.2 μm to 2 μm and the distribution state thereof is preferably monodisperse.

The monodisperse silver halide emulsion for use in this invention is a silver halide emulsion having a grain size distribution of less than 0.25 in the coefficient of variation ($S/\bar{r}$) on the grain sizes of the silver halide grains, wherein $\bar{r}$ is a mean grain size and S is a standard deviation of grain sizes.

That is, if the grain size of each silver halide grain is $r_i$ and the number of the grains is $n_i$, the mean grain size $\bar{r}$ is defined as follows;

$$\bar{r} = \frac{\Sigma n_i \cdot r_i}{\Sigma n_i}$$

and the coefficient of variation S is defined as follows;

$$S = \sqrt{\frac{2(r - r_i)^2 \cdot n_i}{\Sigma n_i}} .$$

Each grain size in this invention is the diameter of a circle having an area corresponding to the projected area of the silver halide grain as viewed by a well-known method in this field (usually, electron microphotography) as described in T. H. James et al "*The Theory of the photographic Process*", 3rd edition, pages 36–43, published by McMillan Co., 1966. Accordingly, when silver halide grains have other forms than that of a sphere (e.g., cube, octahedron, tetradecahedron, tabular form, potato form, etc.), the mean grain size $\bar{r}$ and the standard deviation S can be obtained as described above.

The coefficient of variation of the grain sizes of silver halide grains is 0.25 or less, preferably 0.20 or less, more preferably 0.15 or less, and most preferably 0.10 or less.

(2) To the (100) planes of the above-described host silver halide grains are adsorbed a CR compound as described below.

The CR compound is generally a material which functions to delay or completely obstruct recrystalization and the initiation of the halogen conversion as compared to other crystal planes having no such compound adsorbed thereto by selectively adsorbing onto specific crystal planes and in particular a material which is mainly (selectively) adsorbed on the (100) planes of silver halide grains and functions to restrain the initiation of the recrystalization and the conversion on the (100) planes.

Suitable CR compounds which can be used in this invention, are cyanine dyes, merocyanine dyes, mercaptoazoles (specific examples of which are the compounds shown by formulae (XXI), (XXII) or (XXIII) as described hereinafter in detail), and nucleic acid decomposition products (e.g., intermediate decomposition products of deoxyribonucleic acids or ribonucleic acids, adenine, quanine, uracil, cytocil, thymine, etc.).

In particular, compounds shown by following formulae (I), (II) or (III) described below are preferred in this invention.

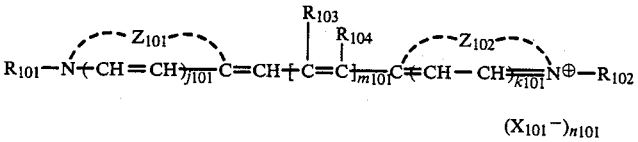

(I)

In the above formula, $Z_{101}$ and $Z_{102}$ each represents an atomic group necessary for forming a heterocyclic nucleus.

Example of suitable heterocyclic nuclei include, 5- or 6-membered cyclic nuclei containing a nitrogen atom and an other atom such as a sulfur atom, an oxygen atom, a selenium atom, or a tellurium atom as the hetero atoms (these rings may have a condensed ring bonded thereto or may be substituted) are preferred.

Specific examples of the aforesaid heterocyclic nuclei are thiazole nuclei, benzothiazole nuclei, naphthothiazole nuclei, selenazole nuclei, benzoselenazole nuclei, naphthoselenazole nuclei, oxazole nuclei, benzoxazole nuclei, naphthoxazole nuclei, imidazole nuclei, benzimidazole nuclei, naphthimidazole nuclei, 4-quinoline nuclei, pyrroline nuclei, pyridine nuclei, tetrazole nuclei, indolenine nuclei, benzindolenine nuclei, indole nuclei, tellurazole nuclei, benzotellurazole nuclei, naphthotellurazole nuclei, etc.

In formula (I), $R_{101}$ and $R_{102}$ each represents an alkyl group, an alkenyl group, an alkynyl group, or an aralkyl group. These groups may be unsubstituted or substituted. For example, the alkyl group included unsubstituted alkyl groups and substituted alkyl groups and these groups may be straight chain, branched, or cyclic groups. The carbon atom number of the alkyl group is preferably from 1 to 8.

Specific examples of substituents for the substituted alkyl groups are a halogen atom (e.g., chlorine, bromine, fluorine, etc.), a cyano group, an alkoxy group, a substituted or unsubstituted amino group, a carboxylic acid group, a sulfonic acid group, a hydroxy group, etc., and the alkyl group may have one substituent or a plurality of substituents.

Specific examples of the alkenyl group are a vinylmethyl group, etc.

Specific examples of the aralkyl group are a benzyl group, a phenethyl groups, etc.

In formula (I) described above, $m_{101}$ represents an integer of 1, 2 or 3.

When $m_{101}$ is 1, $R_{103}$ represents a hydrogen atom, a lower alkyl group, an aralkyl group, or an aryl group and $R_{104}$ represents a hydrogen atom. Specific examples of the aforesaid aryl group are a substituted or unsubstituted phenyl group.

When $m_{101}$ is 2 or 3, $R_{103}$ represents a hydrogen atom and $R_{104}$ represents a hydrogen atom, a lower alkyl group, or an aralkyl group or further may combine with $R_{102}$ to form a 5-membered or 6-membered ring.

Also, when $m_{101}$ is 2 or 3 and $R_{104}$ is a hydrogen atom, $R_{103}$ may combine with the other $R_{103}$ to form a hydrocarbon ring or a heterocyclic ring. These rings are preferably a 5- or 6-membered ring.

In formula (I), $j_{101}$ and $k_{101}$ represent 0 or 1, $X_{101}$ represents an acid anion, and $n_{101}$ represents 0 or 1.

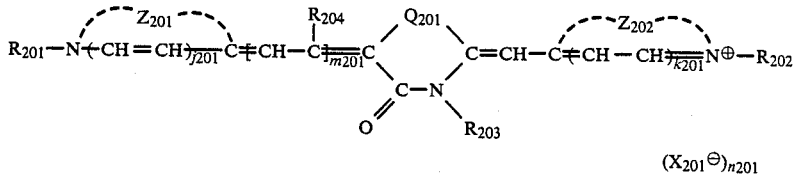

(II)

In formula (II), $Z_{201}$ and $Z_{202}$ have the same significance as $Z_{101}$ or $Z_{102}$. Also, $R_{201}$ and $R_{202}$ have the same significance as $R_{101}$ or $R_{102}$. $R_{203}$ represents an alkyl group, an alkenyl group, an alkynyl group, or an aryl group (e.g., a substituted or unsubstituted phenyl group).

In formula (II), $m_{201}$ represents 0, 1 or 2. $R_{204}$ represents a hydrogen atom, a lower alkyl group, or an aryl group and also when $m_{201}$ is 2, $R_{204}$ and $R_{204}$ may combine with each other to form a hydrocarbon ring or a heterocyclic ring. These rings are preferably a 5- or 6-membered ring.

In formula (II), $Q_{201}$ represents a sulfur atom, an oxygen atom, a selenium atom or $>N-R_{205}$, wherein $R_{205}$ has the same significance as $R_{203}$ and $j_{201}$, $X^-_{201}$, and $n_{201}$ have the same significance as $j_{101}$, $k_{101}$, $X^-_{101}$, and $n_{101}$, respectively, in formula (I).

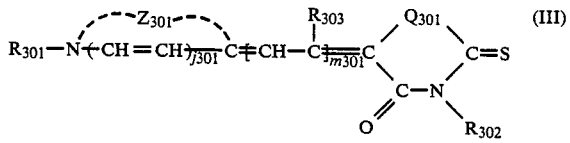

(III)

In formula (III), $Z_{301}$ represents an atomic group necessary for forming a heterocyclic ring.

Examples of suitable heterocyclic rings are the nuclei described above $Z_{101}$ $Z_{102}$ in formula (I) and specific examples of other nuclei are thiazoliadine nuclei, thiazoline nuclei, benzothiazoline nuclei, naphthothiazoline nuclei, selenazolidine nuclei, selenazoline nuclei, benzoselenazoline nuclei, naphthoselenazoline nuclei, benzoxazoline nuclei, naphthoxazoline nuclei, dihydropyridine nuclei, dihydroquinoline nuclei, benzimidazoline nuclei, naphthimidazoline nuclei, etc.

In formula (III) described above, $Q_{301}$ has the same significance as $Q_{201}$ in formula (II), $R_{301}$ has the same significance as $R_{101}$ or $R_{102}$ in formula (I), and $R_{302}$ has the same significance as $R_{203}$ in formula (II).

Also, $R_{303}$ has the same significance as $R_{204}$ in formula (II), and when $m_{301}$ is 2 or 3, $R_{303}$ may combine with other $R_{303}$ to form a hydrocarbon ring or a heterocyclic ring, preferably a 5 to 7-membered ring containing nitrogen atom as a hetero atom.

In formula (III), $j_{301}$ has the same significance as $j_{101}$ in formula (I).

The detailes of the above formulae are described in Japanese Patent Application (OPI) No. 215272/87, pages 22 to 26.

(3) Supply of Bromide Ions:

Bromide ions are preferably supplied slowly at a relatively low concentration. The Bromide ions may be supplied as water-soluble bromide such as potassium bromide but it is desirable to supply ions in the form of a bromide donator capable of controlling the supply amount or the supply rate of bromide ions. For example, organic halogen compounds, inorganic halogen compounds covered by a capsule film or semi-osmosis coating can be used. Specifically, a silver halide having finer grain size than the host grains and a higher silver bromide content than that of the host silver halide grains is preferably used.

For example, when a silver halide emulsion containing host silver chloride grains having the aforesaid CR compound adsorbed thereto is mixed with a silver halide emulsion containing fine silver bromide grains having a mean grain size of about 0.1 μm in an amount corrresponding to about 1 mol% of the host silver chloride grains and the mixed emulsion is ripened, the silver bromide grains are dissolved off and after reaching equilibrium, a layer of a new halogen composition is formed on the surface of the host grains and the reaction stops.

The silver halide composition of the surface of the silver halide grains in this invention can be determined using an ESCA 750 type spectroscope, trade name, made by Shimazu-du Pont Co., by an X-ray photoelectron spectroscopy (XPS) method.

A measurement of silver halide composition by the XPS method is described in Someno and Amoi, *Hyomen Bunseki* (*Surface Analysis*), published by Kodan Sha, 1977.

The silver chloride content in the silver halide composition of the CDG of this invention is preferably 90 mol% or more, and most preferably 95 mol% or more.

The term "composing substantially silver chloride" means that silver chloride is contained in an amount of 90 mol% or more.

In the CDG emulsion for use in this invention, it is preferred for the average silver bromide content of the surface of the CDG to be about 10 mol% or less and the aforesaid "surface" can be considered to be within about 10 lattices according to FIG. 44 on page 136 of above-described *Hyomen Bunseki* (*Surface Analysis*).

It can be seen that by adsorbing the CR compound to the host silver halide grains and ripening the mixture of fine grain silver halide in this invention and CR compound, the development initiating point is controlled and concentrated on the corners or the vicinity of the corners.

In the CDG emulsion for use in this invention, the development center is concentrated and very high speed is obtained, and further since being such is protected by a new silver halide structure the stability of the emulsion is greatly improved and thus excellent stability can be obtained with less fog and without reducing the rapid developing property. Also, since the CDG emulsion has astonishingly high contrast and excellent pressure resistance, the emulsion has the advantages that the occurrence of pressure desentization is less and the formation of fog at unexposed portions is less.

The CR compounds for use in this invention have the characteristic that they can be selected from sensitizing dyes. In particular, the CR compounds useful for the (100) plane can be selected from the compounds shown by formulae (I), (II) and (III) described above and since these compounds have a function as sensitizing dyes, the use of these compounds is advantageous for increasing the spectral sensitivity and, in particular, the spectral sensitivity of the emulsion can be stabilized further. The discovery of such an excellent combination of the CR compounds and the excellent merits thereof is astonishing.

Furthermore, the CR compounds(s) may be combined with other sensitizing dye(s) or super color sensitizer(s) to increase further the sensitivity and stability of the silver halide emulsion.

For example, the CR compounds may be combined with aminostilbene compounds substituted by a nitrogen-containing heterocyclic nucleus group (e.g., the compounds of formula (I), in particular, specifically illustrate compounds (I-1) to (I-17) described in the specification of Japanese Patent Application (OPI) No. 174738/87 filed by the same applicant as herein and the compounds described in U.S. Pat. Nos. 2,933,390 and 3,635,721), aromatic organic acid-formaldehyde condensation products (as described in U.S. Pat. No. 3,743,510), cadmium salts, azaindene compounds, etc. The combinations described in U.S. Pat. Nos. 3,615,613, 3,615,641, 3,617,295, and 3,635,721 are particularly useful.

Then, specific examples of the CR compounds shown by formulae (I), (II), and (III) are illustrated below although the CR compounds in this invention are not limited to these compounds.

CR-1

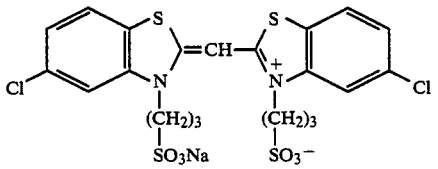

-continued
CR-2
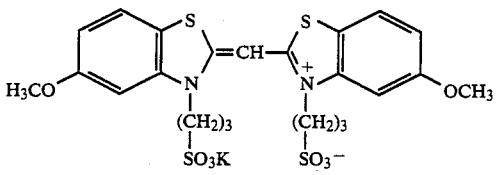
CR-3
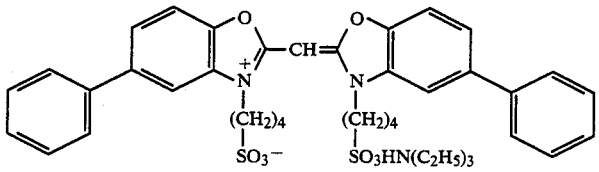
CR-4
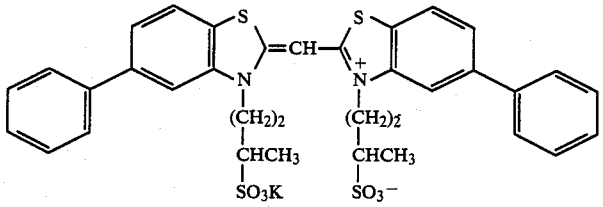
CR-5
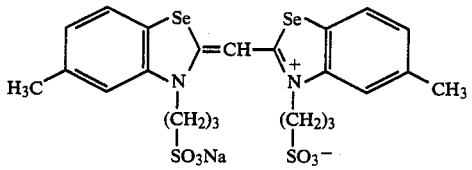
CR-6
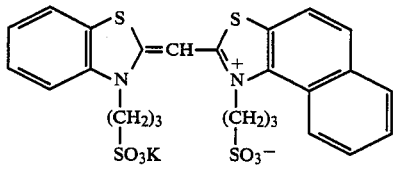
CR-7
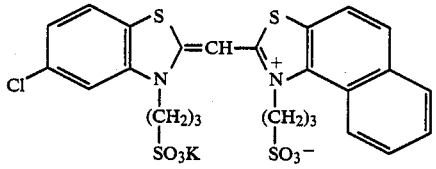
CR-8
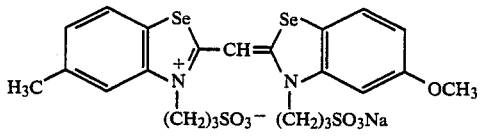
CR-9
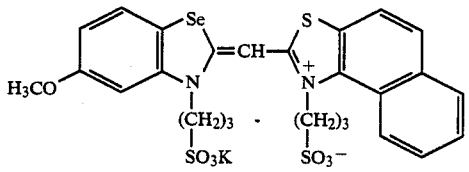

-continued
CR-10
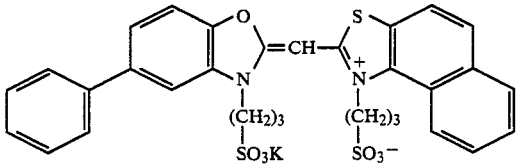
CR-11
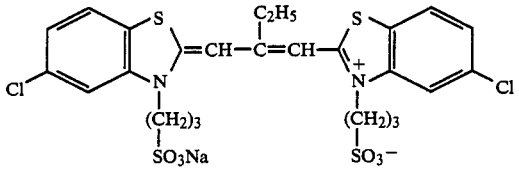
CR-12
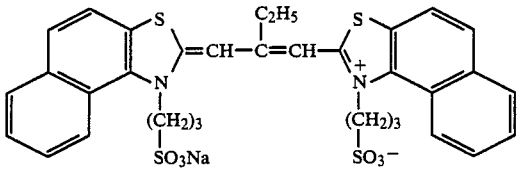
CR-13
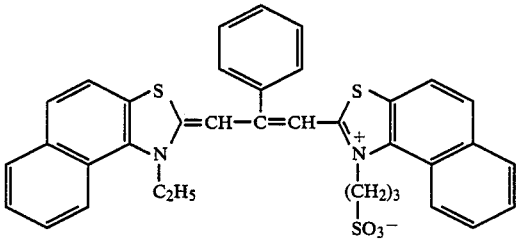
CR-14
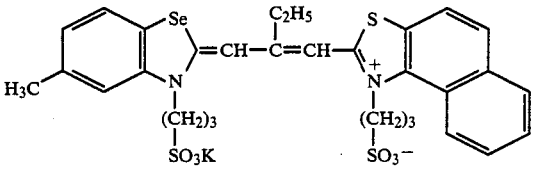
CR-15
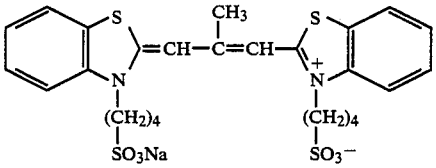
CR-16
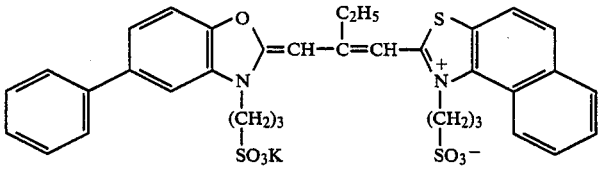
CR-17
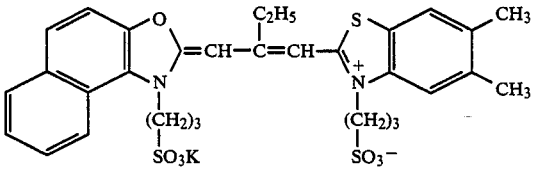

-continued
CR-18
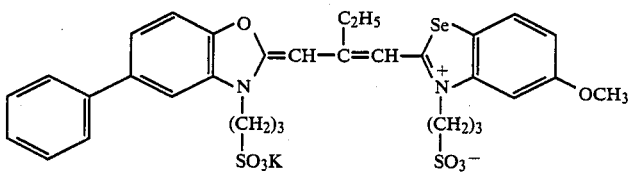
CR-19
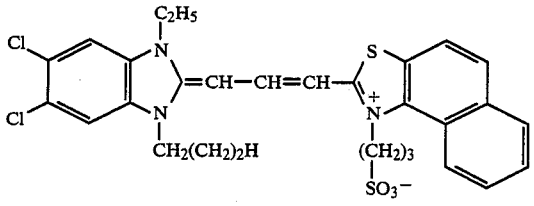
CR-20
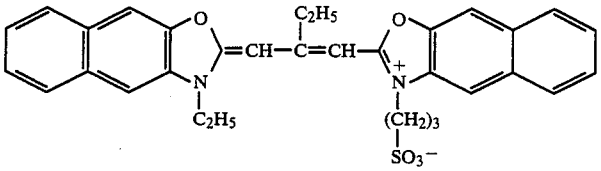
CR-21
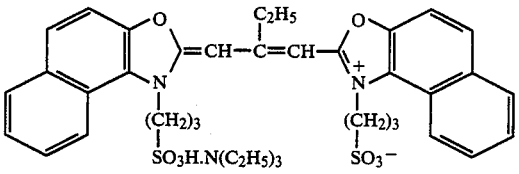
CR-22
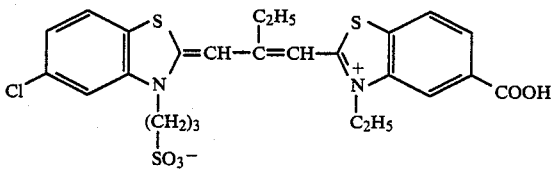
CR-23
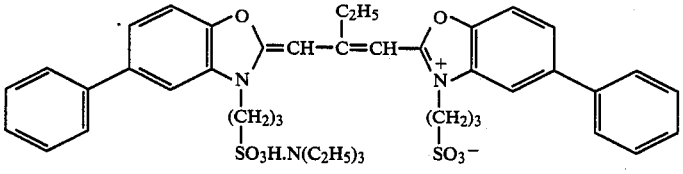
CR-24
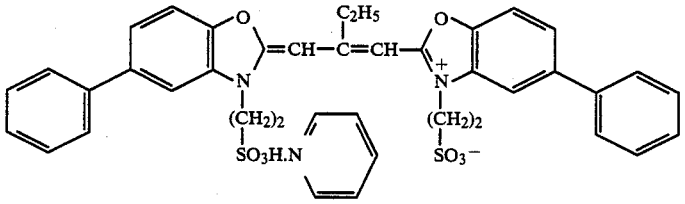
CR-25
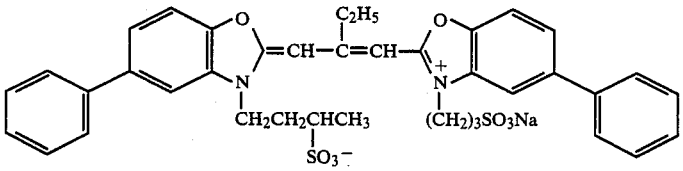

-continued
CR-26
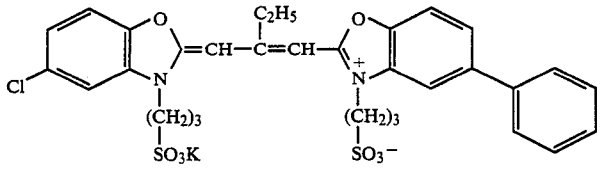
CR-27
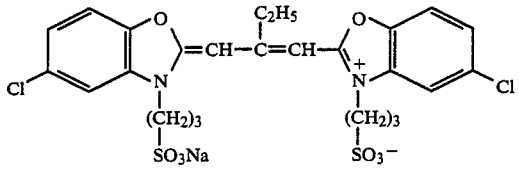
CR-28
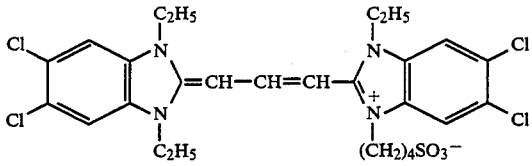
CR-29
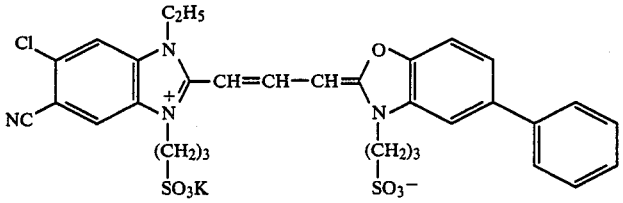
CR-30
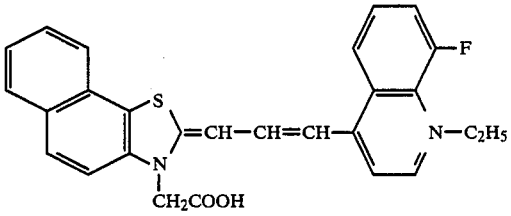
CR-31
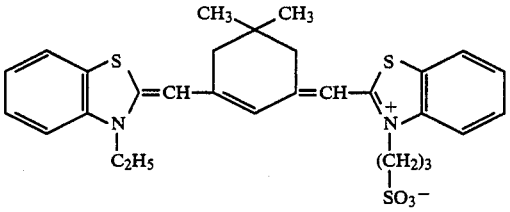
CR-32
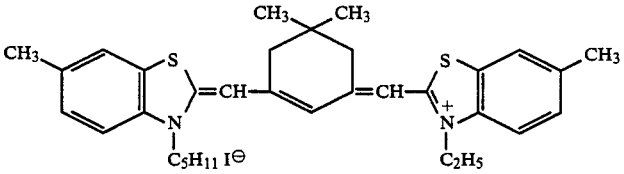
CR-33
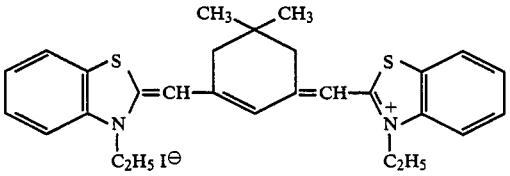

-continued
CR-34
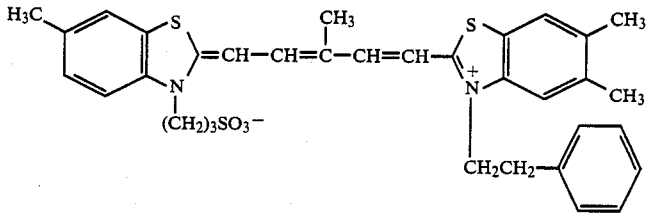
CR-35
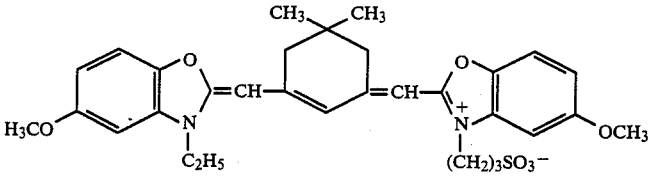
CR-36
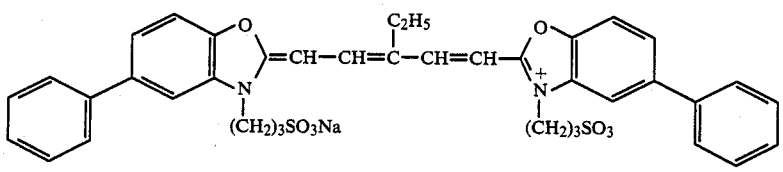
CR-37
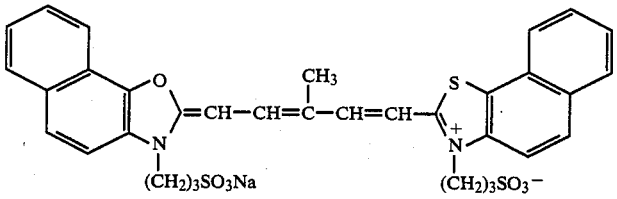
CR-38
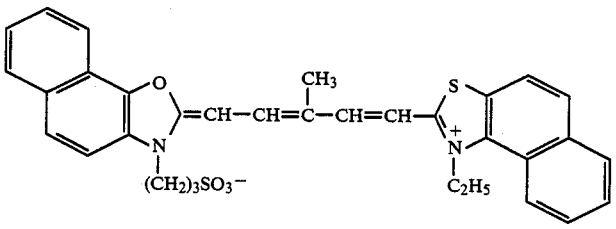
CR-39
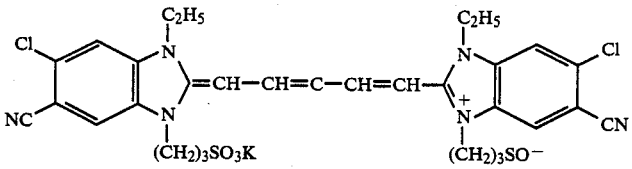
CR-40
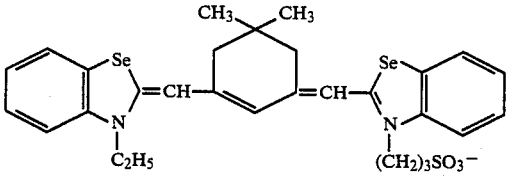
CR-41
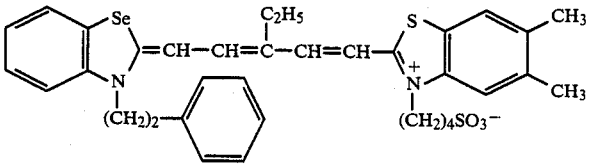

-continued
CR-42
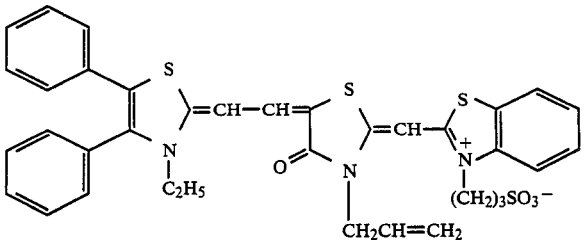
CR-43
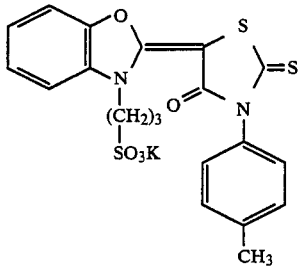
CR-44
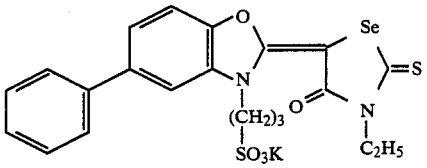
CR-45
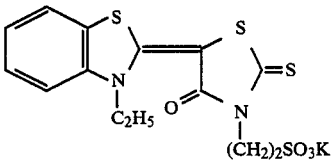
CR-46
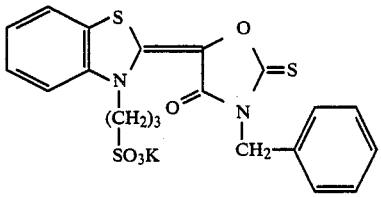
CR-47
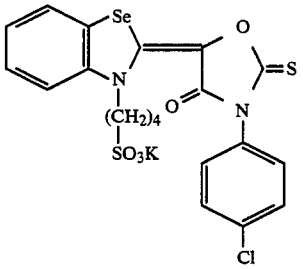
CR-48
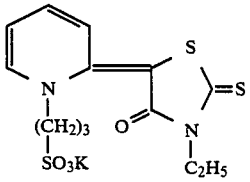

-continued
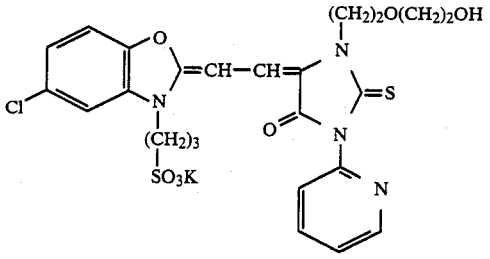
CR-49
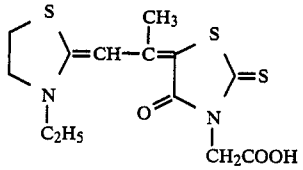
CR-50
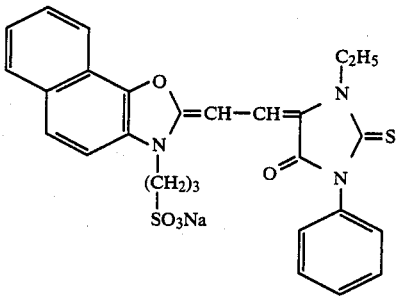
CR-51
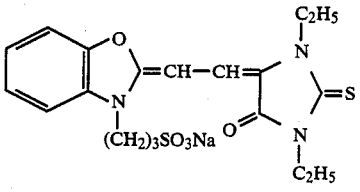
CR-52
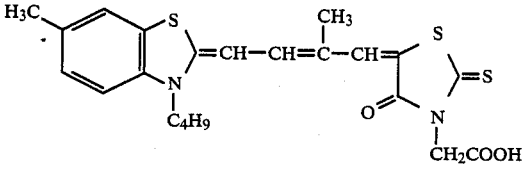
CR-53
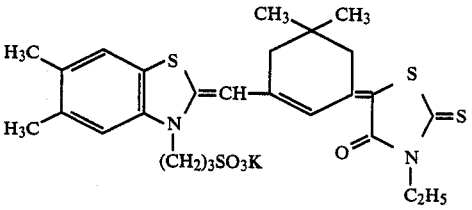
CR-54
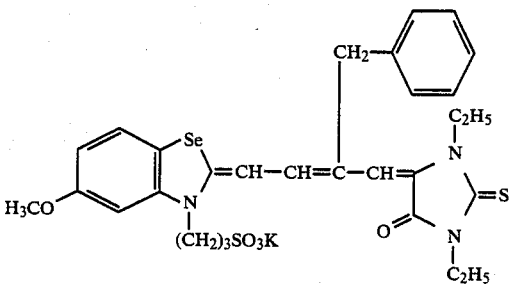
CR-55

-continued

Of the processes to prepare silver halide grains such as a process to add a silver nitrate aqueous solution to an alkali halide aqueous solution, a process of the opposing addition order thereof and a process of the simultaneous addition thereof, preferable process is the simultaneous additive process, more preferably under a content of pAg, to prepare mixed silver halide for obtaining host grains.

The silver halide emulsions for use in this invention are produced by controlling the pH and addition time of silver nitrate and alkali halides.

First, a preferred pH for forming the host silver halide grains in this invention is from 2 to 10. in this case, doping can be applied to the emulsion by using rhodium complex salts, iridium complex salts, lead salts, etc., or a noble metal sensitization (gold sensitization, etc.,) can be applied thereto. As the case may be, sulfur sensitization using a thiosulfate, allylthiocarbamide, cystein, etc., or reduction sesitization using a polyamine, stannous chloride, etc., can be applied to the emulsion.

Then, the aforesaid CR compound is dissolved in a water-miscible organic solvent such as an alcohol (e.g., methanol, etc.), ethyl acetate, etc. or a mixture of such with water and added to the above-described host silver halide emulsion as a solution thereof. Also, the CR compound may be added to the emulsion as a dispersion thereof in an aqueous gelatin solution or an aqueous solution of a surface active agent. The addition amount thereof is preferably from $10^{-5}$ mol% to $10^{-2}$ mol%, and more preferably from $10^{-5}$ mol% to $10^{-3}$ mole% per mol of the host silver halide.

Then, the host silver halide emulsion is mixed with a fine grain high bromide content emulsion as described above and the mixture is ripened while properly controlling the temperature and pAg in the range of from 30° C. to 80° C. and the silver ion concentration range of pAg 5 to 10, respectively.

Thereafter, if necessary, sensitizing dye(s) or super color sensitizer(s) may be added thereto for spectral sensitization.

It is preferred to apply the chemical sensitization as described above to the silver halide emulsion during or after ripening the mixture.

Also, fog inhibitors such as mercaptotriazoles, mercaptotetrazoles, benzotriazoles, etc., can be used the silver halide emulsion for use in this invention.

For rapid processing, a silver chlorobromide emulsion containing a high content of silver chloride is preferably used and for the emulsion, fog inhabitors or stabilizers strongly adsorbing to the silver halide grains, such as mercapto compounds, nitrobenzotriazole compounds, benzotriazole compounds, etc., are used. Also, development accelerators, halation preventing agents, irradiation preventing agents, optical whitening agents, etc., may be used for the silver halide emulsions.

Most preferred stabilizers which are used for the silver halide emulsions in this invention are those represented by following formula (XXI), (XXII) or (XXIII):

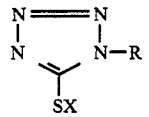

(XXI)

wherein R represents an alkyl group, an alkenyl group or an aryl group and X represents a hydrogen atom, an alkali metal atom, an ammonium group or a precursor thereof.

Examples of alkali metal atoms are a sodium atom, a potassium atom, etc., and examples of the ammonium group are a tetramethylammonium group, aa triemthylbenzylammonium group, etc. Also, the precursor is a group capable of becoming a hydrogen atom or an alkali metal atom under alkaline conditions and examples thereof are an acetyl group, a cyanoethyl group, a methanesulfonylethyl group, etc.

In the above-described groups shown by R, the alkyl group and alkenyl group include unsubstituted groups and substituted groups as well as alicyclic groups.

Examples of substituents for the substituted alkyl group are a halogen atom, a nitro group, a cyano group, a hydroxy group, an alkoxy group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an aalkylthio group, an arylthio group, a heterocyclic thio group, a carboxylic acid group, a sulfonic acid group, or the salts of these acids.

The above-described ureido group, thioureido group, sulfamoyl group, carbamoyl group, and amino group each includes unsubstituted groups, N-alkyl-substituted group, and N-aryl-substituted groups.

Examples of aryl group are a phenyl group and a substituted phenyl group and examples of substituents are an alkyl group and the substituents described above as to the substituent for the alkyl group.

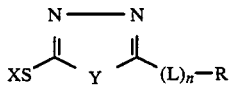

(XXII)

wherein Y represents a sulfur atom or an oxygen atom; L represents a divalent linking group; R represents a hydrogen atom, an alkyl group, an alkenyl group, or an aryl group; X has the same significance as X in formula (XXI) described above; and n represents 0 or 1.

The alkyl group and the alkenyl group shown by R, and X have the same significance as defined above as to R and X of formula (XXI).

Specific examples of the divalent linking group shown by L are

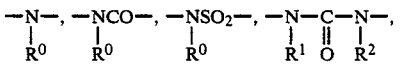

-continued

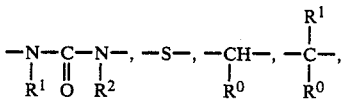

etc., (wherein $R^0$, $R^1$, and $R^2$ each represents a hydrogen atom, an alkyl group, or an aralkyl group) or a combination thereof.

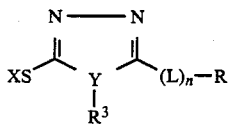

(XXIII)

wherein R and X have the same significance as defined above for formula (XXI); L has the same significance as defined above for formula (XXII); $R^3$ has the same significance as defined R.

The compound shown by formula (XXI), (XXII), or (XXIII) described above can be incorporated in any of the layers of a silver halide color photographic material of this invention and/or in a color developer. The term "any of the layers of silver halide color photographic material" means light-sensitive emul9lsion layer(s) and/or the light-insensitive hydrophilic colloid layer(s) of the color photographic material.

The addition amount of the compound shown by formula (XXI), (XXII), OR (XXIII) is preferably from $1\times10^{-5}$ mol to $5\times10^{-2}$ mol, and more preferably from $1\times10^{-4}$ mol to $1\times10^{-2}$ mol per mol of silver halide where such is incorporated in the silver halide color photographic material and is preferably from $1\times10^{-6}$ mol/liter to $1\times10^{-3}$ mol/liter, and more preferably from $5\times10^{-6}$ mol/liter to $5\times10^{-4}$ mol/liter, where such is incorporated in a color developer.

Specific examples of the compounds shown by formulae (XXI), and (XXIII) are illustrated below but the invention is not to be coustruedas being limited to them. In addition, the compounds shown below are described at pages 11 to 30-1 of the specification of Japanese Patent Application No. 114276/86.

XXI-1

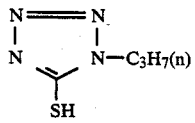

XXI-2

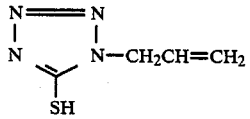

XXI-3

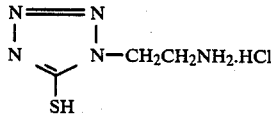

XXI-4

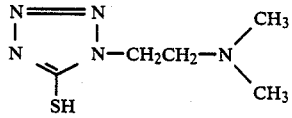

-continued

XXI-5

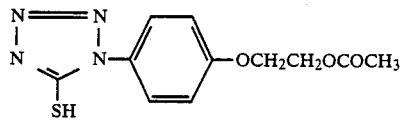

XXI-6

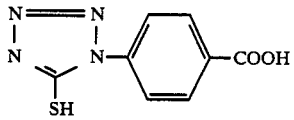

XXI-7

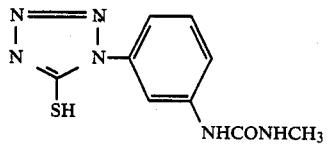

XXI-8

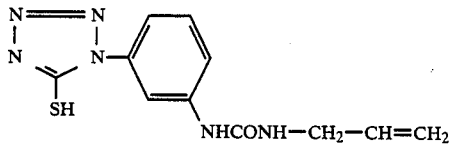

XXII-1

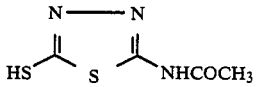

XXII-2

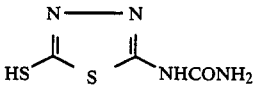

XXII-3

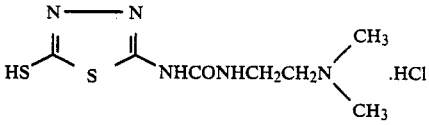

XXII-4

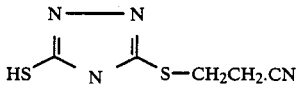

XXII-5

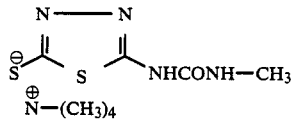

XXIII-1

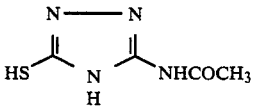

XXIII-2

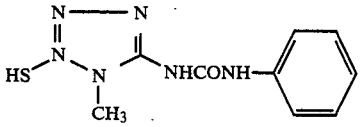

Color couplers which are used in this invention are explained below.

In addition to general requirements such as color hues and high extinction coefficient for the color couplers, since the CDG emulsion shown particularly high development progress, the color couplers must have high activity so that the coupling coloring reaction of the couplers with the oxidation product of a color developing agent such as a p-phenylenediamine derivative does not become the rate determining step. From this view point, use of the couplers represented by following formula (IV), (V), (VI), or (VII) is preferred in this invention.

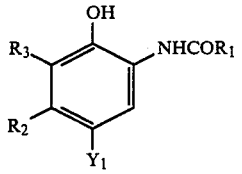
(IV)

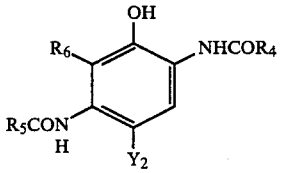
(V)

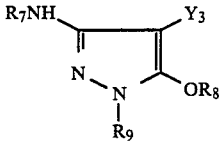
(VI)

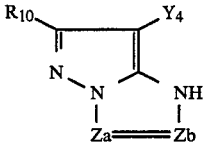
(VII)

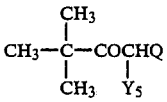
(VIII)

wherein $R_1$, $R_4$, and $R_5$ each represents an aliphatic group, an aromatic group, a heterocyclic group, an aromatic amino group, or a heterocyclic amino group; $R_2$ represents an aliphatic group; $R_3$ and $R_6$ each represents a hydrogen atom, a halogen atom, an aliphatic group, an aliphatic oxy group, or an acylamino group; $R_7$ and $R_9$ each represents a substituted or unsubstituted phenyl group; $R_8$ represents a hydrogen atom, an aliphatic acyl group, an aromatic acyl group, an aliphatic sulfonyl group, or an aromatic sulfonyl group; $R_{10}$ represents a hydrogen atom or a substituent; Q represents a substituted or unsubstituted N-phenylcarbamoyl group; Za and Zb each represents methine, substituted methine, or =N—; $Y_1$, $Y_2$, and $Y_4$ each represents a halogen atom or a group capable of releasing on coupling with the oxidation product of a color developing agent (hereinafter, referred to as releasing group); $Y_3$ represents a hydrogen atom or a releasing group; and $Y_5$ represents a releasing group.

In formulae (IV) and (V) described above, R2 and R3 or R5 and R6 may combine and form a 5-, 6-, or 7-membered ring.

Furthermore, the compound shown by formula (IV), (V), (VI), (VII), or (VIII) described above may form a dimer or higher polymer at $R_1$, $R_2$, $R_3$, or $Y_1$; $R_4$, $R_5$, $R_6$, or $Y_2$; $R_7$, $R_8$, $R_9$, or $Y_3$; $R_{10}$, $Z_a$, $Z_b$, or $Y_4$; or Q or $Y_5$.

Details of $R_1$, $R_2$, $R_3$, $R_4$, $R_5$, $R_6$, $R_7$, $R_8$, $R_9$, $R_{10}$, $Z_a$, $Z_b$, $Q_1$, $Y_1$, $Y_2$, $Y_3$, and $Y_4$ in formulae (IV), (V), (VI), (VII), and (VIII) are same as those described in regard to formulae (I), (II), (III), (IV), and (V) described in pages 17-3 to 34 of the specification of Japanese Patent Application No. 175233/86.

Specific examples of these couplers are couplers (C-1) to (C-40), couplers (M-1) to (M-42), and couplers (Y-1) to (Y-46) described in pages 36 to 78-3 of the specification of Japanese Patent Application No. 175233/86 and more preferable examples of the couplers are as follows.

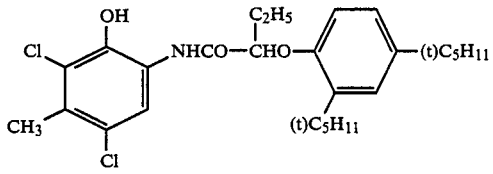
C-1

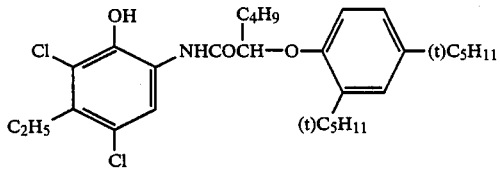
C-2

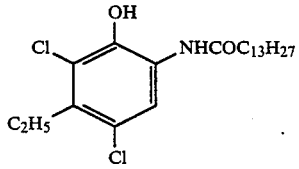
C-3

-continued
C-4
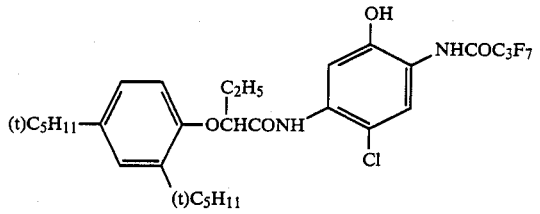
C-5
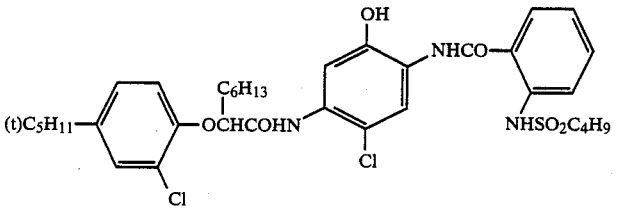
C-6
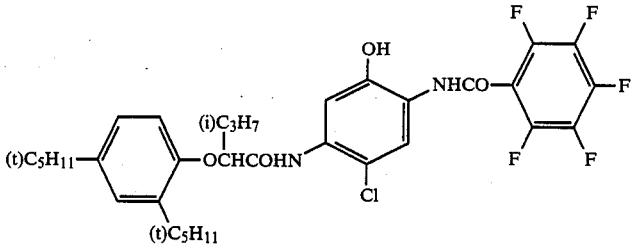
C-7
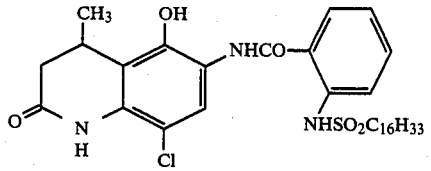
C-8
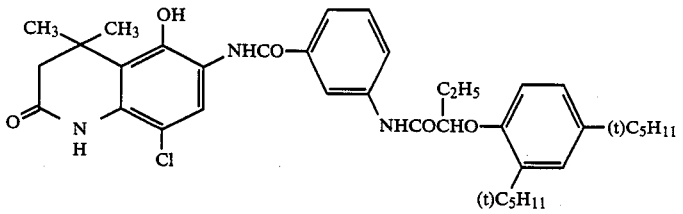
C-9
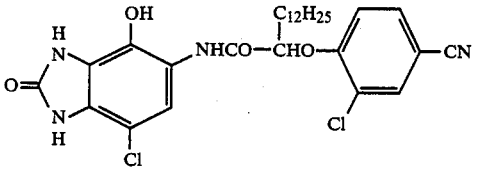
C-10
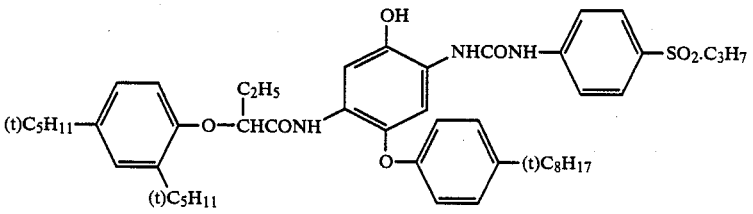

-continued
C-11
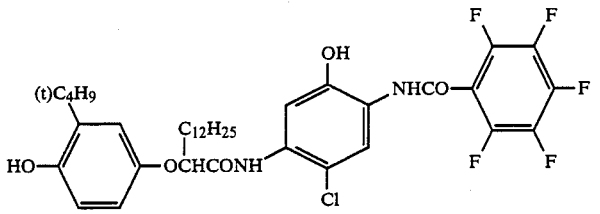
C-12
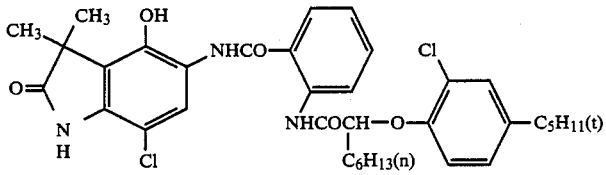
C-13
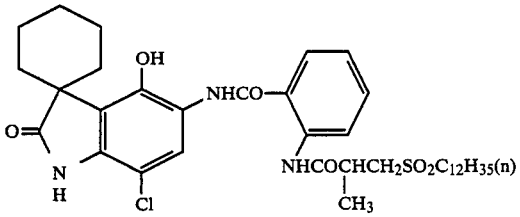
C-14
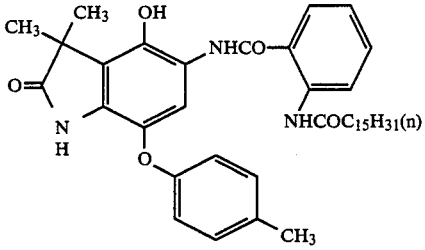
C-15
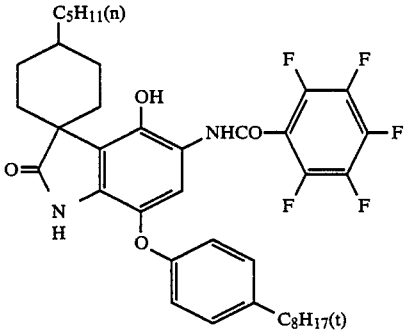
C-16
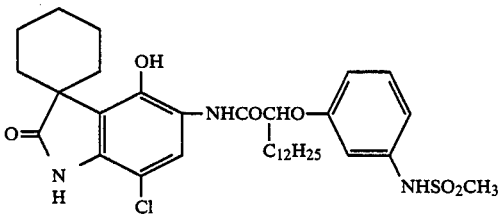
C-17
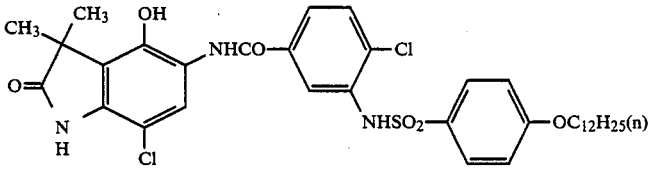

-continued
M-1
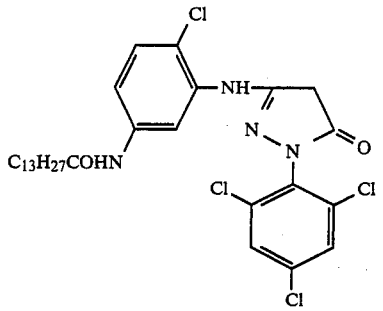
M-2
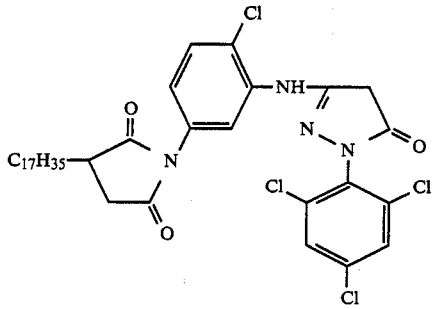
M-3
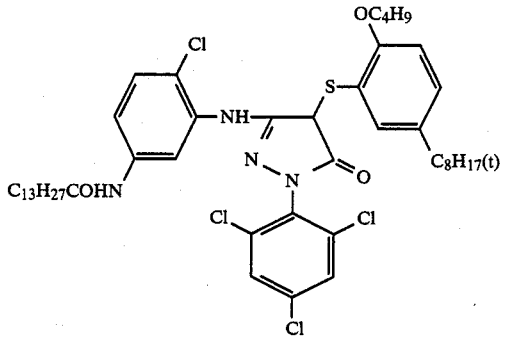
M-4
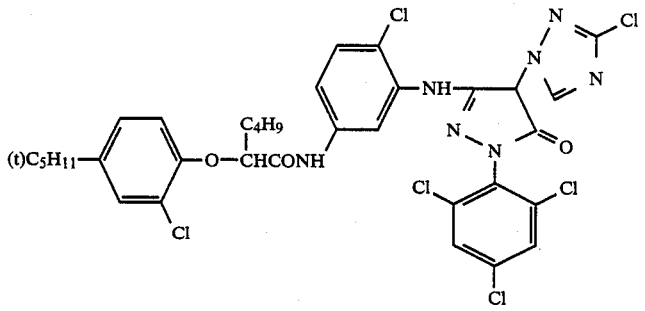
M-5
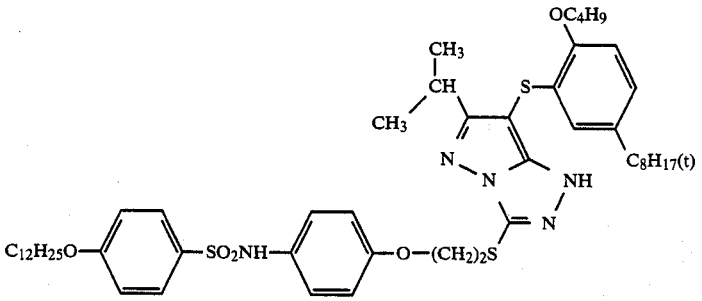

-continued
M-6
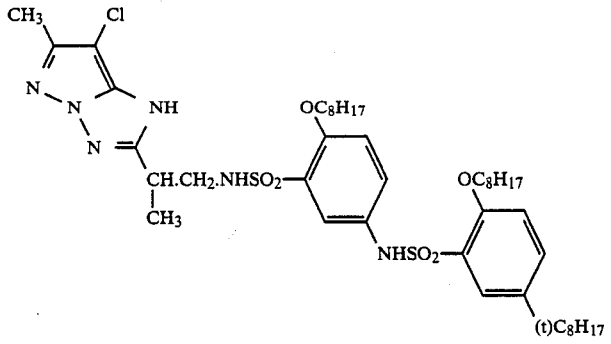
M-7
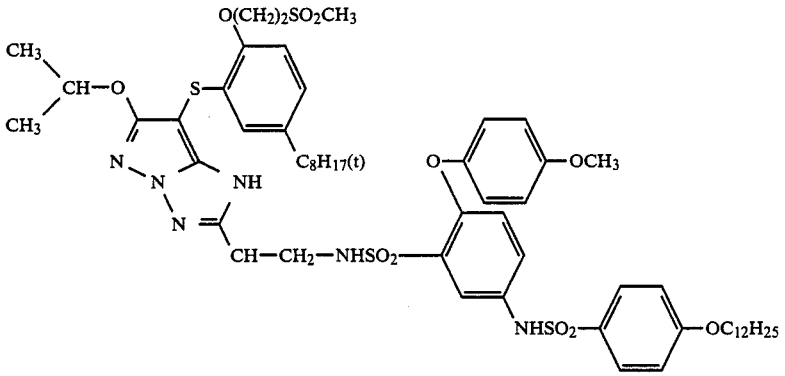
M-8
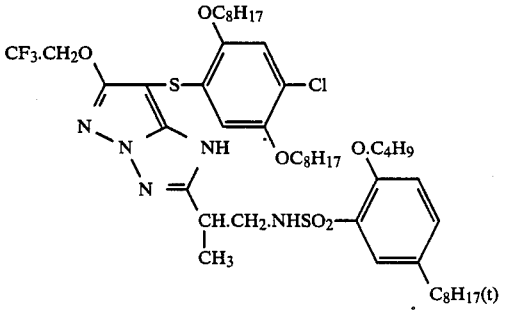
M-9
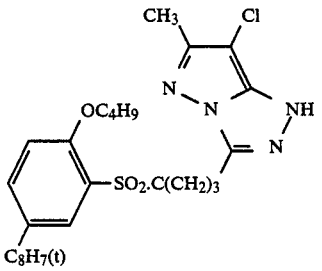
M-10
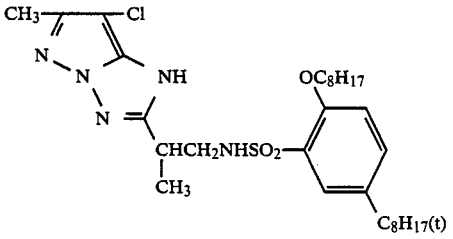

-continued
M-11
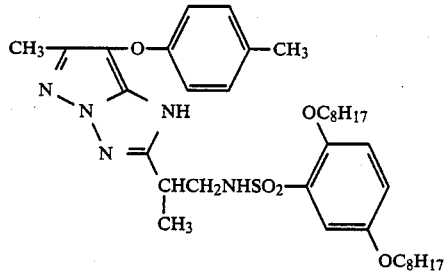
M-12
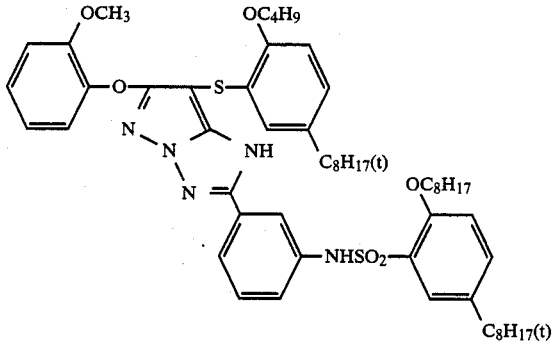
M-13
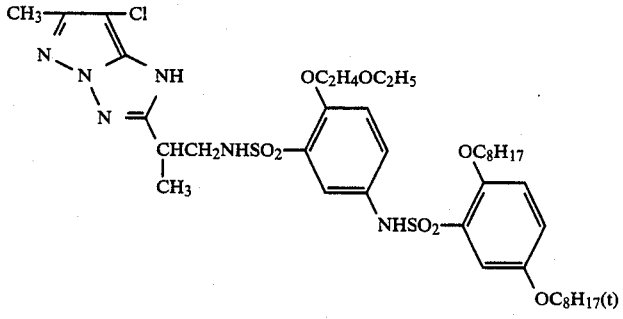
M-14
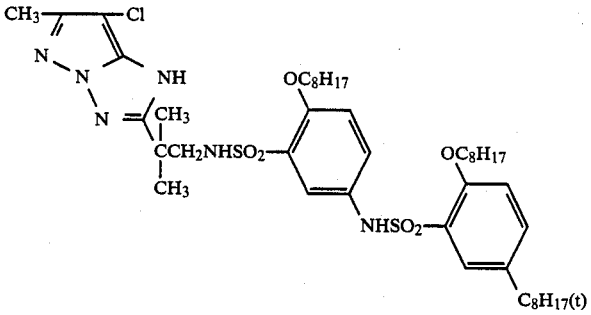
M-15
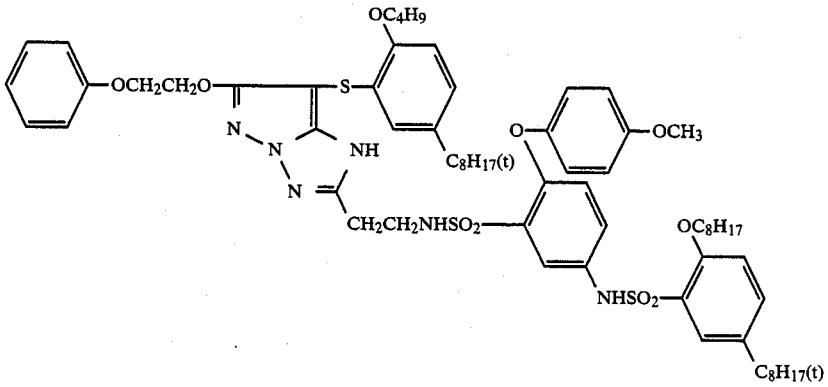

-continued
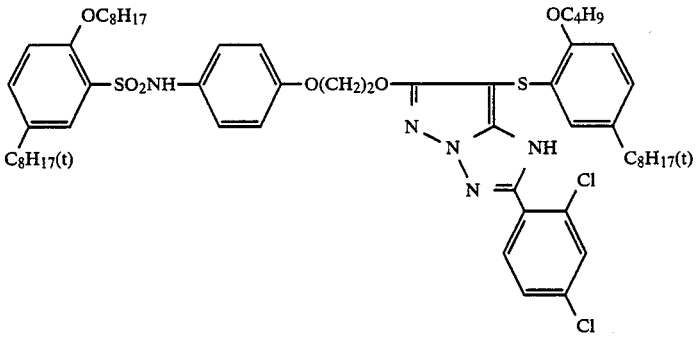
M-16
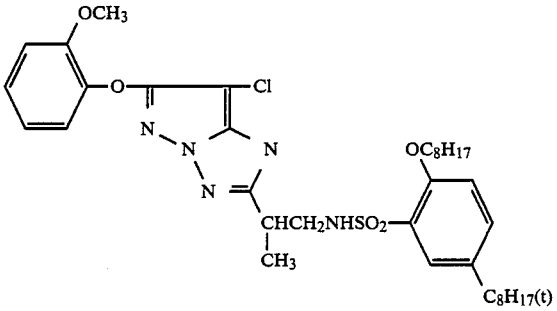
M-17
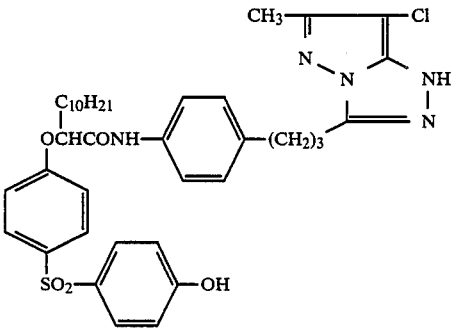
M-18
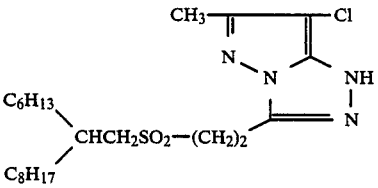
M-19
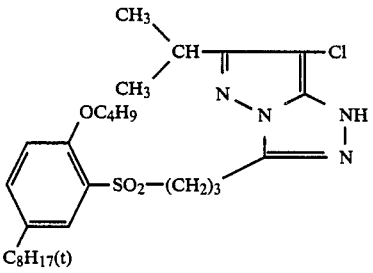
M-20

-continued
M-21
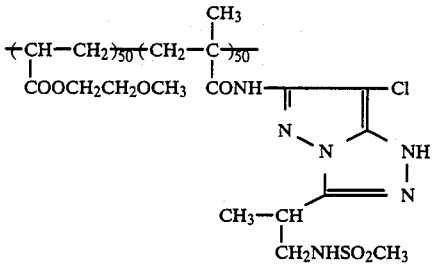
M-22
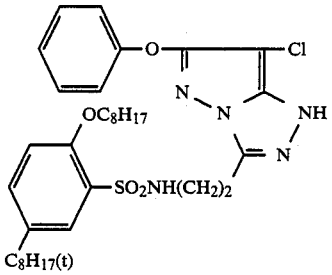
M-23
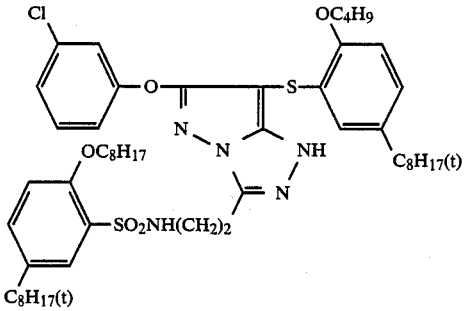
Y-1
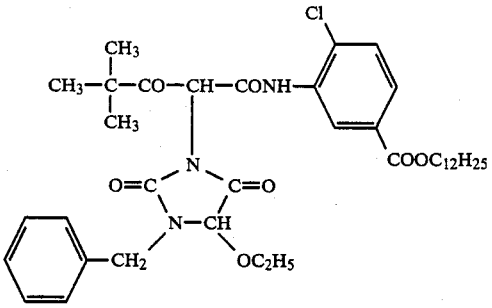
Y-2
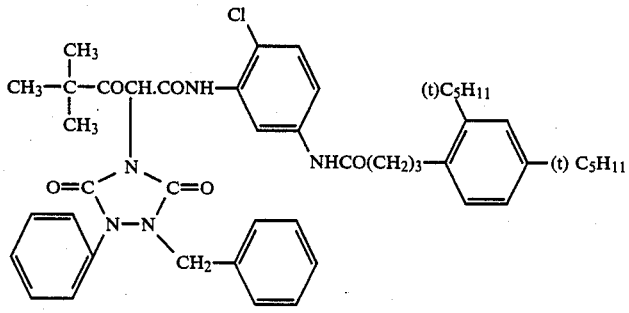

-continued

Y-3

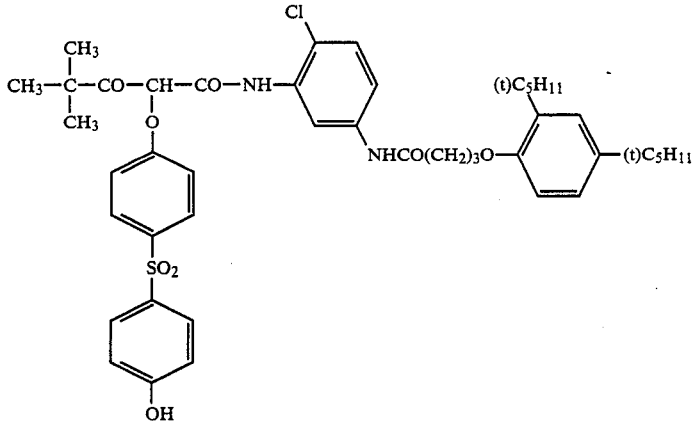

Y-4

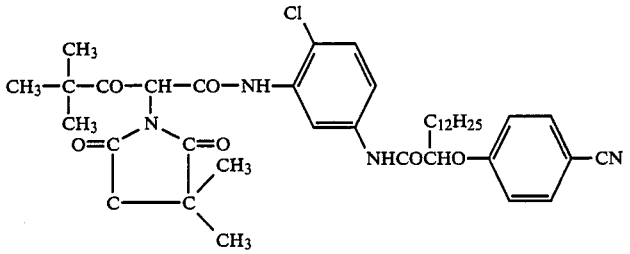

Y-5

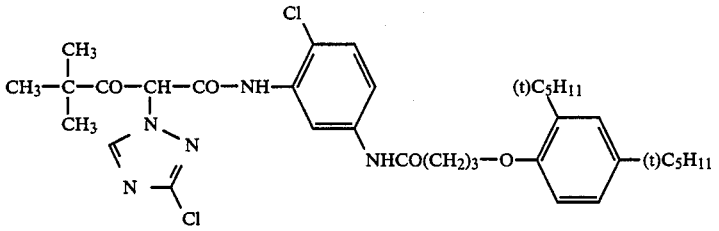

The generally used amount of the color coupler described above is in the range of from 0.001 to 1 mol per mol of light-sensitive silver halide, and preferably is from 0.01 to 0.5 mol for a yellow coupler, from 0.003 to 0.3 mol for a magenta coupler, and from 0.002 to 0.3 mol for a cyan coupler, per mol of light-sensitive silver halide.

In the silver halide color photographic material of this invention using the color couplers shown by formula (IV), (V), (VI), (VII) or (VIII) described above, the preferred amount of silver halide coated is from 1.5 $g/m^2$ to 0.1 $g/m^2$ in the case of using a reflection support and from 7 $g/m^2$ to 0.2 $g/m^2$ in the case of using a transparent support.

These couplers are incorporated in silver halide emulsion layers as a dispersion in at least one high-boiling organic solvent. In this case, high-boiling organic solvents represented by following formula (A) to (E) are preferably used.

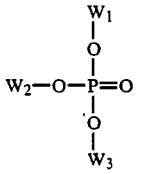

(A)

$W_1—COO—W_2$ (B)

-continued

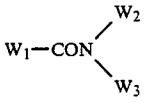

(C)

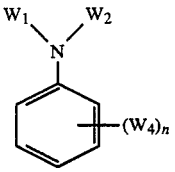

(D)

$W_1—O—W_2$ (E)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group or a substituted or unsubstituted heterocyclic group; $W_4$ represents $W_1$, $OW_1$, or $S—W_1$; and n represents an integer of from 1 to 5; when n is an integer of 2 ot more $W_4S$ may be the same or different; and in formula (E), said $W_1$ and $W_2$ may combine and form a condensed ring.

The color photographic emulsions of this invention may further contain hydroquinone derivatives, aminophenol derivatives, amines, gallic acid derivatives, catechol derivatives, ascorbic acid derivatives, non-coloring couplers, sulfonamidophenol derivatives, etc., as color fogging preventing agentor color mixing preventing agents.

For the color photographic materials of this invention, fading preventing agents can be used. Typical examples of organic fading preventing agents are hyroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and the ether or ester derivatives obtained by silyling or alkylating the phenolic hydroxy groups of these compounds. Also, metal complexes such as (bissalicylaldoxymate) nickel complexes and (bis-N,N-dialkyldithiocarbamte) nickel complexes can be used.

Compounds having both moiety structures of hindered amine and hindered phenol in the same molecule as described in U.S. Pat. No. 4,268,593 can be used with good results for the prevention of the deterioration of yellow color images formed by heat, moisture and light. Also, spiroindanes described in Japanese Patent Application (OPI) No. 159644/81 and chouromans substituted by hydroquinone diether or monoether as described in Japanese Patent Application No. 89835/80 can be used with good results for preventing the deterioration of magenta dye images formed by, in particular light.

Furthermore, the image stabilizers described in Japanese Patent Application (OPI) No. 125732/84 can be particularly advantageously used for stabilizing magenta images formed using pyrazolotriazole type magenta couplers.

For improving storage stability, in particular light fastness of the cyan images formed, benzotriazole series ultraviolet absorbents are preferably used together. The ultraviolet absorbent may be co-emulsified with the cyan coupler.

The coating amount of the ultraviolet absorbent may be that sufficient for imparting light stability to cyan dye images but since if the amount thereof is too high, unexposed portions (background portions) of the color photographic material are sometimes yellowed, the amount thereof is usually in their range of from $1\times10^{-4}$ mol/m$^2$ to $2\times10^{-3}$ mol/m$^2$, and in particular, from $5\times10^{-4}$ mol/m$^2$ to $1.5\times10^{-3}$ mol/m$^2$.

Ultraviolet absorbents are incorporated in one of both layers adjacent cyan coupler-containing red-sensitive emulsion layer or, preferably in both the layers, in a conventional layer construction of color photographic paper. When ultraviolet absorbents are incorporated in an interlayer between a green-sensitive silver halide emulsion layer and a red-sensitive silver halide emulsion layer, the ultraviolet absorbents may be co-emulsified with color mixing preventing agents. Also, when ultraviolet absorbents are incorporated in a protective layer, another protective layer may be formed thereon as the outermost layer. The outermost protective layer may contain a matting agent with an optional particle size or a mixture of latexes having different particle sizes.

In the color photographic material of this invention, ultraviolet absorbents may be incorporated in hydrophilic colloid layer(s) as well.

When a reflection support, which can be used in this invention, is employed, it is preferred for color images formed in the silver halide emulsion layers to be viewed clearly and this is achieved by increasing the reflectivity of the support, examples of such supports include a support coated with a hydrophobic resin containing a light reflecting material such as titanium oxide, zinc oxide, calcium carbonate, calcium sulfate, etc., and a support composed of a vinyl chloride resin having a light reflective material dispersed therein. For example, there are baryta-coated papers, polyethylene-coated paper, poly-propylene series synthetic papers, transparent supports having formed thereon a reflective layer or containing therein a reflective material, this transparent support being polyester films such as polyethylene terephthalate films, triacetyl cellulose films, cellulose nitrate films, etc., polyamide films, polycarbonate films, polystyrene films, etc. These supports may be appropriately selected depending on use. Also, the supports having a mirror plane reflective surface or a second class diffusion reflective surface as described in Japanese Patent Application (OPI) No. 210346/85, Japanese Patent Application Nos. 168800/86 and 168801/86, etc.

Transparent supports can also be used in this invention. Transmittance of light of the transparent support is preferably not more than 50%.

This invention can be applied to a multilayer multicolor photographic light-sensitive material having at least two different spectral sensitivities on a support. A multilayer natural color photographic material usually has at least one red-sensitive silver hade emulsion layer, at least one green-sensitive silver halide emulsion layer, and at least one blue-sensitive silver halide emulsion layer on a support. The order of these layers can be optionally selected as desired. Also, each of the above-described silver halide emulsion layers may be composed of two or more silver halide emulsion layers having different light sensitivity or a light-insensitive layer may be present between two or more silver halide emulsion layers having the same color sensitivity.

It is preferred that the color photographic light-sensitive material of this invention has auxiliary layers such as protective layer(s), interlayers, a filter layer, antihalation layer(s), a backing layer, etc., in addition to silver halide emulsion layers on a support.

As a binder or a protective colloid which can be used for the emulsion layers and other hydrophilic colloid layers of the color photographic light-sensitive material of this invention, gelatin is advantageously used but other hydrophilic colloids can be also used.

Examples of suitable protective colloids are proteins such as gelatin derivatives, graft polymers of gelatin and other polymers, albumin, casein etc.; cellulose derivatives such as hydroxyethyl cellulose, carboxymethyl cellulose, cellulose sulfuric acid ester, etc.; saccharose derivatives such as sodium alginate, starch derivatives, etc.; and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

Lime gelatin as well as acid-treated gelatin and enzyme-treated gelatin as described in *Bull, Soc. Sci. Phot. Japan,* No. 16, 30(1966) may be used as the gelatin and further the hydrolyzed products and the enzyme decomposition products of gelatin can be also used.

The color photographic materials of this invention may further contain various additives such as stabilizers, stain preventing agents, developing agents or precursors thereof, development accelerators or the precursors therefor, lubricants, mordants, matting agents, antistatic agents, plasticizers, and other photographically useful additives in addition to the above-described additives. Typical examples of these additives are described in *Research Disclosure,* No. 17643 (December, 1978) and ibid, No. 18716 (November, 1979).

The color photographic materials of this invention may further contain water-soluble dyes in the hydrophilic colloid layers as filter dyes or for irradiation prevention, halation prevention, and other various purposes.

Also, the color photographic materials of this invention may further contain stilbene series, triazine series, oxazole series, or coumarine series whitening agents in the photographic emulsion layers or other hydrophilic colloid layers. These whitening agents may be water-soluble or water-insoluble whitening agents may be used as the form of dispersion.

Another feature of this invention is quick stabilization of the color development process and in a color development process shorter than 3 minutes and 40 seconds, preferably shorter than 3 minutes, more preferably shorter than 2 minutes and 30 seconds.

When a reflective support is used in this invention, the coating amount of silver halide is about 1.5 g/m$^2$ or less, and preferably about 1.2 g/m$^2$ or less, as the amount of silver and also when a transparent support is used, the coating amount of silver halide is about 7 g/m$^2$ or less, and preferably 5 g/m$^2$ or less. The reduced coating amount of silver halide is very useful not only for color development but also to improve the desilvering step.

An aromatic primary amino color developing agent which is used for a color developer in the case of developing the color photographic materials of this invention includes various color developing agents widely used in various color photographic processes. These color developing agents include aminophenol series derivatives and p-phenylenediamine series delivatives. Preferred examples of color developing agents are p-phenylenediamine derivatives and specific examples thereof are illustrated below without limiting, however, the color developing agents which can be used in this invention.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-metjyl-N-ethyl-N-methoxyethylaniline
D-10: 4-Amino-3-methyl-N-ethyl-N-β-ethyoxyethylaniline
D-11: 4-Amino-3-methyl-N-ethyl-N-β-ethyoxyethylaniline.

Also, these p-phenylenediamine derivatives may be salts thereof, such as sulfates, hydrochlorides, sulfites, p-toluenesulfonates, etc. The above-described compounds are described in U.S. Pat. Nos. 2,193,015 2,552,241, 2,566,271, 2,592,364, 3,656,950, 3,698,525, etc.

The amount of the aromatic primary amine color developing agent used is from about 0.1 g to about 20 g, and preferably from about 0.5 g to about 10 g, per liter of color developer.

The color developer which is used in this invention may contain hydroxylamines.

The hydroxylamine may be used in the form of the free amine in the color developer but is generally used in the form of a water-soluble acid salt thereof. Examples of such salts are the sulfates, oxalates, hydrochlorides, phosphates, carbonates, acetates, etc. Hydroxylamines may be substituted or unsabstituted hydroxylamines, for example, the nitrogen atom of the hydroxylamine may be substituted with an alkyl group.

The addition amount of hydroxylamine is preferably from 0 to 10 g, and more preferably from 0 to 5 g, per liter of color developer. If the stability of color developer is maintained, the addition amount thereof preferably is as small as possible.

Also, it is preferred that the color developer contains sulfite such as sodium sulfite, potassium sulfite, sodium bisulfite, potassium bisulfite, sodium metasulfite, potassium metasulfite, or a carbonyl sulfuric acid addition product as a preservative. The addition amount thereof is preferably from 0 to 20 g/liter, and more preferably from 0 to 5 g/liter. The amount thereof preferably is as small as possible such that the stability of the color developer is maintained.

Other preservatives which can be used are aromatic polyhydroxy compounds described in Japanese Patent Applicaton (OPI) Nos. 49828/77, 47038/81, 32140/81, 160142/84, and U.S. Pat. No. 3,746,544; hydroxyacetones described in U.S. Pat. No. 3,615,503 and British Pat. No. 1,306,176; α-aminocarbonyl compounds described in Japanese Patent Application (OPI) Nos. 143020/77 and 89425/78; various metals described in Japanese Patent Application (OPI) Nos. 44148/82 and 53749/82; various saccharides described in Japanese Patent Application (OPI) No. 102727/77; α-α'-dicarbonyl compounds described in Japanese Patent Application (OPI) No. 160141/84; salicylic acids described in Japanese Patent Application (OPI) No. 180588/84; alkanolamines described in Japanese Patent Application (OPI) No. 3532/79; poly(alkyleneimines) described in Japanese Patent Application (OPI) No. 04349/81; gluconic acid derivatives described in Japanese Patent Application (OPI) No. 75647/81, etc.

These preservatives may be used as a mixture thereof if desired.

Particularly preferred preservatives are 4,5-dihydroxy-m-benzenedisulfonic acid, poly(ethyleneimine), and triethanolamine.

The pH of the color developer which is used for developing the color photographic materials of this invention is preferably form 9 to 12, and more preferably from 9 to 11.0. The color developer may further contain other compounds known as components for color dvelopers.

To maintain aforesaid pH, a buffer is preferred, suitable buffers are carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1, 3-propanediol salts, valine salts, proline salts, trishydroxyaminomethane salts, lysine salts, etc. In particular, carbonates, phosphates, tetraborates, and hydroxybenzoates have the advantages that they have excellent solubility and also buffer action at high pH region of higher than 910, they are added to color developer without adversely influencing (fog, etc.,) photographic properties, and they are available at low cost and hence these buffers is particularly preferred.

Specific examples of these buffers are sodium carbonate, potassium carbonate, sodium bicarbonate, potassium bicarbonate, sodium tertiaryphosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the buffers for use in this invention are not limited to these compounds.

The addition amount of the buffer to the color developer is preferably more than 0.1 mol/liter, and particularly preferably from 0.1 mol/liter to 0.4 mol/liter.

Furthermore, color developers of this invention may contain various chelating agents as a precipitation preventing agent for calcium or magnesium, or for improving the stability of the color developers.

Suitable chelating agents are preferably organic acid compounds and examples thereof are aminopolycarboxylic acids described in Japanese Patent Publication Nos. 30496/73 and 30232/69, organic sulfonic acids described in Japanese Patent Application (OPI) No. 96347/81, Japanese Patent Publication No. 39359/81, and West German Pat. No. 2,227,639, phosphonocarboxylic acids described in Japanese Patent Application (OPI) Nos. 102726/77, 42730/78, 121127/79, 126241/80, and 65956/80, and the compounds described in Japanese Patent Application (OPI) Nods. 195845/83, 203440/83, and Japanese Patent Publication No. 40900/78. Specific examples of chelating agents are illustrated below without limiting the chelating agents for use in this invention:

nitrilotriacetic acid,
diethyleneaminopentaacetic acid,
ethylenediaminetetraacetic acid,
triethylenetetraminehexaacetic acid,
N,N,N-trimethylenephosphonic acid,
ethylenediamine-N,N,N',N'-tetramethylenephosphonic acid,
1,3-diamino-2-propnaol-tetraacetic acid,
trans-cyclohexanediaminetetraacetic acid,
nitrilotripropionic acid,
1,2-diaminopropanetetraacetic acid,
hydroxyethyliminodiacetic acid,
glycol ether diaminetetraacetic acid,
hydroxyethylenediaminetriacetic acid,
ethylenediamine-o-hydroxyphenylacetic acid,
2-phosphonobutane-1,2-4-tricarboxylic acid,
1-hydroxyethane-1, 1-diphosphonic acid, and
N,N'-bis(2-hydroxubenzyl)ethylenediamine-N,N'-diacetic acid.

These chelating agents may be, if desired, used as a mixture of two or more. The addition amount of the chelating agent may be that sufficient for blocking metal ions in the color developer and, for example, from 0.1 g to 10 g per liter of the color developer is a suitable amount.

The color developer may further contain, if described, a development accelerator.

Examples of development accelerator or thioether series compounds described in Japanese Patent Publications 16088/52, 5987/52, 7826/63, 12380/69, 9019/70, and U.S. Pat. No. 3,813,247, p-phenylenediamine series compounds described in Japanese Patent Application (OPI) Nos. 49829/77 and 15554/75, quaternary ammonium salts described in Japanese Patent Application (OPI) Nos. 137726/75, 156826/81, and 43429/77, and Japanese Patent Publication No. 30074/69, p-aminophenols described in U.S. Pat. Nos. 2,610,122 and 4,119,462, amino series compounds described in U.S. Pat. No. 2,494,903 3,128,812, 4,230,796, 3,253,919, 2,482,546, 2,596,926, and 3,582,346, and Japanese Patent Publication No. 11431/66, polyalkylene oxides described in Japanese Patent Publication Nos. 16088/62, 25201/67, 11431/66, and 23882/67, and U.S. Pat. Nos. 3,128,183 and 3,532,501, and, further, 1-phenyl-3-pyrazolidones, hydrazines, meso-ion type compounds, thione type compounds, imidazoles, etc.

In particular, thioether series compounds and 1-phenyl-3-pyrazlidones are preferred.

The color developer used in this invention may further contain, if desired, optionally an antifoggant.

Suitable antifoggants are an alkali metal halide such as potassium bromide, sodium chloride, potassium iodide, etc., or other organic antifoggants may be used on combination with the above-described compound shown by formula (XXI), (XXII), or (XXIII). Specific examples of organic antifoggants are nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, hydroxyazaindrizine, etc.; other mercapto-substituted heterocyclic compounds than those shown by formula (XXI), (XXII), or (XXIII) described above, such as 2-mercatobenzimidazole, 2-mercaptobenzothiazole, etc.; adenine; and further mercapto-substituted aromatic compounds such as thiosalicyclic acid.

These antifoggants may be dissolved from the color photographic materials during processing and accumulated in the color developer but the accumulated amount is preferably less from the stand point of reducing the amount to be discharged.

It is also preferred for the color developer in this invention to contain an optical whitening agent. Examples of optical whitening agents are 4,4-diamino-2,2'-disulfostilbene series compounds and these preferred. The addition amount thereof is from 0 to 5 g/liter, and preferably from 0.1 g/liter to 2 g/liter.

Also, if desired, the color developer may contain a surface active agent such as an alkylsulfonic acid, an aryl-sulfonic acid, the aliphatic carboxylic acid, an aromatic carboxylic acid, etc.

The temperature of use of the color developer for developing the color photographic materials of this invention is preferably from 30° C. to 50° C., and more preferably from 30° C. to 42° C.

The replenishing amount for the color developer is less than 2,000 ml, and preferably less than 1,500 ml, per square meter of color photographic material but the replenishing amount is preferably less from the standpoint of reducing the amount of waste solution. For instance, the replenishing amount of color printing photographic material is generally 400 ml or less, more preferably 150 ml or less.

In this invention, for increasing the speed of the processing by a color developer without any benzyl alcohol, which is disadvantageous in the points of environmental contamination, storage stability of color images, and occurrence of stains, being present, it is preferred to use in the color development system a restoring agent for the oxidation product of a color developing agent and a trapping agent for the oxidation product of the restoring agent as described in Japanese Patent Application No. 259799/86.

Suitable bleaching agents for the bleach solution or blix (bleach-fix) solution which can be used for processing the color photographic materials after color development include ferric ion complexes. i.e., the complexes of ferric ions and a chelating agent such as an aminopolycarboxylic acid, an aminopolyphosphoric acid, or the salts thereof.

The aminopolycarboxyaltes or aminopolyphosphates are the salts of aminopolycarboxylic acids or aminopolyphosphoric acids and an alkali salt, ammonium salt, or a water-soluble amine salt are suitable.

Examples of alkali metal salts are sodium, potassium, lithium, etc., and examples of the water-soluble amine salts are salts of alkylamines such as methylamine, diethylamine, triethylamine, butrylamine, etc., alicyclic amines such as alkylamine, cyclohexylamine, etc., arylamines such as aniline, m-toluidine, etc., and heterocyclic amines such as pyridine, morpholine, piperidine, etc.

Typical examples of these aminopolycarboxylic acids, aminopolyphosphoric acids, and the salts thereof useful as chelating agents are;

ethylenediaminetetraacetic acid,
ethylenediaminetetraacetic acid disodium salt,
ethylenediaminetetraacetic acid diammonium salt,
ethylenediaminetetraacetic acid tetra(trimethylammonium) salt,
ethylenediaminetetraacetic acid tetra-potassium salt,
ethylenediaminetetraacetic acid tetra-sodium salt,
ethylenediaminetetraacetic acid tri-sodium salt,
ethylenediaminetetraacetic acid
diethylenetriaminepentaacetic acid,
diethylenetriaminepentaacetic acid penta-sodium salt,
ethylenediamine-N-(β-oxyethyl)-N,N',N'-triacetic acid,
ethylenediamine-N-(β-oxyethyl)-N,N',N'-triacetic acid tri-sodium salt,
ethylenediamine-N-(β-oxyethyl)-N,N',N'-triacetic triammonium salt,
propylenediaminetetraacetic acid,
propylenediaminetetraacetic acid disodium salt,
nitrilotriacetic acid,
nitrilotriacetic acid trisodium salt,
cyclohexanediaminetetraacetic acid,
cyclohexanediaminetetraacetic acid disodium salt,
iminodiacetic acid,
dihydroxyethylglycine,
ethyl ether diaminetetraacetic acid,
glycol ether diaminetetraacetic acid,
ethylenediaminetetrapropionic acid,
phenylenediaminetetraacetic acid,
1,3-diaminopropanol-N,N,N',N'-tetramethylenephosphonic acid,
ethylenediamine-N,N,N',N'-tetramethylenephosphonic acid,
1,3-propylenediamine-N,N',N'-tetramethylenephosphonic acid etc.

The ferric ion complex may be used in the form of a complex salt or may be formed in a solution using a ferric salt such as ferric sulfate, ferric chloride, ferric nitrate, ferric ammonium sulfate, ferric phosphate, etc., and a chelating agent such as aminopolycarboxylic acid, aminopolyphosphoric acid, phosphonocarboxylic acid, etc. In the case of use in the form of a complex salt, the complexes may be used along or as a mixture of two or more complexes. On the other hand, where the complex salts(s) are formed in solution using a ferric salt and a chelating agent, the ferric salts may be used alone or as a mixture of two or more kinds of ferric salts. Furthermore, the chelating agents may be used alone or as a mixture of two or more thereof. Also, in any cases, the chelating agent(s) may be used in an excessive amount to the amount of ferric ion complex formed. As the ferric complexes, aminopolycarboxylic acid ferric complexes are preferred and the addition amount thereof is from 0.01 to 1.0 mol/liter, and preferably from 0.05 to 0.50 mol/liter.

The bleach solution or the blix solution may, if desired, contain a bleach accelerator. Specific examples of useful bleach accelerators are compounds having a mercapto group or a disulfide group as described in U.S. Pat. No. 3,893,858, West German Pat. Nos. 1,290,812, and 2,059,988, and Japanese Patent Application (OPI) Nos. 32736/78, 57831/78, 37418/78, 65732/78, 72623/78, 95630.78, 95631/78, 104232/78, 124424/78, 141623/78, 28426/78, *Research Disclosure,* No. 17129 (July, 1978), etc.; thiazolidine derivatives as described in Japanese Patent Application (OPI) No. 140129/75, thiourea derivatives described in Japanese Patent Publication No/8506/70, Japanese Patent Application (OPI) Nos. 20832/77 and 32735/78, and U.S. Pat. No. 3,706,561; iodides described in West German Pat. No. 1,127,715, and Japanese Patent Application (OPI) No. 16235/83; polyethylene oxides described in West German Pat. Nos. 966,410 and 2,748,430; polyamine compounds described in Japanese Patent Publication No. 8836/70; the compounds described in Japanese Patent Application (OPI) Nos. 42434/74, 59644/74, 94927/78, 35727/79, 26506/80, and 163940/83; and iodide ions, bromide ions, etc.

Of the aforesaid compounds, the compounds having a mercapto group or a disulfide group are preferred from the standpoint providing a large acceleration effect and the compounds described in U.S. Pat. No. 3,893,858, West German Pat. No. 3,893,858, West German Pat. No. 1,290,812, and Japanese Patent Application (OPI) No. 95630/78 are particularly preferred.

Furthermore, the bleach solution or the blix solution used in this invention may contain a rehalogenating agent such as a bromide (e.g., potassium bromide, sodium bromide, ammonium bromide, etc.), a chloride (e.g., potassium chloride, sodium chloride, ammonium chloride, etc.), or an iodide (e.g., ammonium iodide). Also, the bleach solution or blix solution may further contain, if desired, a corrosion preventing agent, e.g., inorganic acids, organic acids, and alkali metal or ammonium salts thereof each having a pH buffer capability, such as boric acid, borax, sodium metaborate, acetic acid, sodium acetate, sodium carbonate, potassium carbonate, phopshorous acid, phosphoric acid, sodium phosphate, citric acid, sodium citrate, tartaric acid, ammonium nitrate, etc., or guanidine, etc.

Suitable fixing agents for the blix solution or the fix solution which is used in this invention are thiosulfates such as sodium thiosulfate, ammonium thiosulfate, etc.; thiocyanates such as sodium thiocyanate, ammonium thiocyanate, etc.; thioether compounds such as ethylenebis-thioglycolic acid, 3,6-diethia-1,8-octanediol, etc.; and water-soluble silver halide solvents such as thioureas, etc. They can be used alone or as a mixture thereof.

Also, a specific blix solution containing fixing agent and a large amount of a halide such as potassium iodide described in Japanese Patent Application (OPI) No. 155354/80 can be used. In this invention, the use of a thiosulfate, in particular ammonium thiosulfate is preferred.

The amount of the fixing agent is preferably from 0.3 mol/liter to 2 mols/liter, and more preferably from 0.5 mol/liter to 1.0 mol/liter.

The pH range of the blix solution or fix solution used in this invention is preferably 3 to 10, and more preferably from 4 to 9. If the pH is lower than the aforesaid range, the deterioration of the solution and the formation of leuco compound from cyan dyes are accelerated although desilvering may be improved. Also, if the pH is higher than the range, desilvering is delayed and stain tends to form.

To control the pH, sulfuric acid, nitric acid, acetic acid (glacial acetic acid), bicarbonate, ammonia, potassium hydroxide, sodium hydroxide, sodium carbonate, potassium carbonate, etc., may be added thereto to control the pH.

Also, the blix solution may further contain an optical whitening agent, a defoaming agent, a surface active agent, and an organic solvent such as polyvinylpyrrolidone, methanol, etc.

Furthermore, the blix solution or fix solution in this invention contains a sulfite ion-releasing compound such as a sulfite (e.g., sodium sulfite, potassium sulfite, and ammonium sulfite), a bisulfite (e.g., ammonium bisulfite, sodium bisulfite, and potassium bisulfite), a metabisulfite (e.g., potassium metabisulfite, sodium metabisulfite, and ammonium bisulfite), etc., as a preservative. The amount of the preservative is preferably from about 0.02 mol/liter to 0.50 mol/liter, and more preferably from about 0.04 to 0.40 mol/liter calculated as sulfide ions.

As the preservative, a sulfite is generally used but ascorbic acid, a carbonyl bisulfurous acid addition product, a carbonyl compound, etc., may be used together with the sulfite.

Furthermore, the blix solution or the fix solution may contain, if necessary, a buffer agent, an optical whitening agent, a chelating agent, an antifungal agent, etc. etc.

It is preferred to use at least one of ion (III) complex salts of ion (III) complex salts of ethylenediaminetetaacetic acid, diethylenetriaminepentaacetic acids, and ion (III) complex salts of cyclohexanediaminetetraacetic acids for the blix solution or the bleach solution in this invention.

The wash step in this invention is explained below.

In this invention, a simple "stabilization processing" only without substantially employing wash step in place of ordinary "wash processing" can be employed. Thus, "wash processing" in this invention is used in the broad meaning as described above.

The amount of washing water is not easily defined since the amount depends upon the number of tanks for multistage countercurrent washing and the amount of the component carried by the color photographic materials from prior baths but the bleach and fix components may be carried to the final wash bath or tank. For example, in the case of a 3-tank countercurrent washing, the amount of wash water is preferably more than about 1,000 ml, more preferably more than 5,000 ml, per square meter of color photographic material. Also, in the case of water saving processing, it is better to use water in an amount of from 100 ml to 1,000 ml per square meter of color photographic material.

The washing temperature is usually from 15° C. to 45° C., and preferably from 20° C. to 35° C.

Wash water from the wash step may contain various compounds for preventing precipitation and stabilizing wash water. For example, chelating agents such as inorganic phosphoric acids, aminopolycarboxylic acids, organic phosphonic acids, etc., antibacterial or antifungal agents for preventing the growth of various bacteria, algae, and molds, such as the compounds described in *Journal of Antibacterial and Antifungal Agents*, Vol. 11, No. 5, 207–223(1983) and the compounds described in Hiroshi Horiguchi, *Bokin Bobai no Kagaku* (*Antibacterial and Antifungal Chemistry*), metal salts such as magnesium salts and aluminum salts, alkali metal salts, ammonium salts, and surface active agents can be present. Moreover, the compounds described in *Journal of Photographic Science and Engineering*. Vol. 6, 344–359(1065) may be added thereto.

Further, water from which calcium compounds and magnesium compounds are deleted, which is described in Japanese Patent Application No. 133632/61, may be used as a wash water instead of antifungal.

This invention is particularly effective in greatly saving the amount of wash water by adding a chelating agent, an antibacterial agent, and an antifungal agent to the wash water and by employing multistage countercurrent washing using two or more tanks. Also, the invention is effective in practicing multistage countercurrent stabilization processing (so-called stabilization processing)as described in Japanese Patent Application (OPI) No. 8543/82 in place of an ordinary wash step. in these cases, the blix component in the final bath may be $5\times10^{-2}$ or less, and preferably $1\times10^{-2}$ or less.

The stabilization solution in this invention contains various compounds for stabilizing color images formed. For example, various additives such as various buffers for controlling the pH (e.g., pH 3 to 8) of the photographic layers (e.g., borates, metaborates, borax, phosphates, carbonates, potassium hydroxide, sodium hydroxide, aqueous ammonia, monocarboxylic acids, dicarboxylic acids, polycarboxylic acids, etc., as a combination thereof) and an aldehyde such as form aldehyde can be present. Other additives for the stabilizing solution are chelating agents (e.g., inorganic phosphoric acids, aminopolycarboxylic acids, organic phosphonic acids, aminopolyphosphonic acids, phosphonocarboxylic acids, etc.), sterilizers (e.g., thiazole series sterlilzers, isothiazole series sterilizers, halogenated phenols, sulfonylamide, benzotriazole, etc.), surface active agents, optical whitening agents, hardening agents, etc. They may be used as a mixture two or more of the same kind or different kinds of additives.

Also, it is preferred to improve the storage stability of the color images obtained to add various ammonium salts such as ammonium chloride, ammonium nitrate, ammonium sulfate, ammonium phosphate, ammonium sulfite, ammonium thiosulfate, etc., to the stabilization solution as a pH controlling agent for the processor.

In greatly saving the amount of wash water as described above, it is preferred to reduce the amount of waste solution that a part or all of the overflow solution of the wash water is supplied to a blix bath or fix bath, which is a pre-bath.

In continuously performing the process step in this invention, a constant finish is obtained by preventing a change in the composition of each processing solution using a replenisher for each processing solution. The amount of each replenisher can be reduced to a half or less than a half of the standard amount of the replenisher for a reduction in cost.

Each processing bath may be, if desired, equipped with a heater, a temperature sensor, a liquid level sensor, a circulation pump, a filter, a floating lid, a squeegee a nitrogen gas stirrer, an air stirrer, etc.

For the color photogrphic materials of this invention can be applied any processing using color developer. For example, photographic processing for color photographic papers, color reversal photographic papers, color positive photographic films, color negative photographic films, color reversal photographic film, etc., can be employed.

As described hereinbefore, corner development type grain silver halide emulsion (CDG emulsions) are used in this invention.

The experiments for preparing CDG emulsions and confirming the corner developing property of the emulsions were carried out as follows.

| Experiment (1): Formation of host silver chloride grains: | |
|---|---|
| Solution 1 | |
| Water | 1,000 ml |
| Sodium Chloride | 5.5 g |
| Gelatin | 32 g |
| Solution 2 | |
| Sulfuric Acid (1N) | 24 ml |
| Solution 3 | |
| Compound A shown below (aq. 1% soln.) | 3 ml |
| 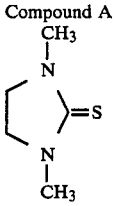 | |
| Solution 4 | |
| Sodium chloride | 1.7 g |
| Water to make | 200 ml |
| Solution 5 | |
| Silver Nitrate | 5 g |
| Water to make | 200 ml |
| Solution 6 | |
| Sodium chloride | 41.3 g |
| $K_2IrCl_6$ (0.001% soln.) | 0.5 ml |
| Water to make | 600 ml |
| Solution 7 | |
| Silver Nitrate | 120 g |
| Water to make | 600 ml |

After heating Solution 1 to 76° C., Solution 2 and Solution 3 were added to the solution.

Thereafter, Solution 4 and Solution 5 were simultaneously added to the mixture thus formed over a period of 10 minutes.

Ten minutes latter, Solution 6 and Solution 7 were simultaneously added to the mixture over a period of 35 minutes and 5 minutes after the addition, the temperature of the system was lowered and desalting was carried out. Then, water and a gelatin dispersion was added to the mixture and the pH thereof was adjusted to 6.3 to provide a monodisperse cubic grain silver chloride emulsion having a mean grain size of 1.1 μm and a variation coefficient of 0.10. (a value obtained by dividing a standard derivation by an average grain size.)

The emulsion thus formed was split into two equal-volume portions. To one of them were added a 0.6% solution of a blue spectral sensitizing dye (CR-7 described above) in an amount of 12.6 ml as the CR compound and further a fine grain silver bromide emulsion having a mean grain size of 0.05 μm in an amount of 0.5 mol% to the host silver chloride emulsion, and the mixed emulsion was ripened for 10 minutes at 58° C. Thereafter, sodium thiosulfate was added to the emulsion to apply thereto optimum chemical sensitization and the aforesaid stabilizer [(XXI)-(7)] was added thereto at $10^{-4}$ mol/molAg to provide Emulsion (B). The remaining portion of the emulsion not containing any CR compound, etc., was designated Emulsion (A).

Each of Emulsion (A) and Emulsion (B) thus formed was mixed with an emulsified dispersion of a yellow coupler (ExY) (the structure of the coupler is shown below in Example 1) and after adjusting the composition thereof as shown hereinafter, the emulsion was coated on a polyethylene terephthalate (PET) film and a protective layer of a thickness of 3 μm composed of gelatin was formed on the emulsion layer. In these cases, 1-oxy-3,5-cichloro-s-triazine sodium salt was used as a gelatin hardening agent.

PREPARATION OF EMULSIFIED DISPERSION OF COUPLER

To 19.1 g of the yellow coupler (ExY)* and 4.4 g of a color image stabilizer (Cpd-1)* were added 27.2 ml of ethyl acetate and 7.7 ml of a solvent (Solv-1)* to form a solution and the solution thus formed was dispersed by emulsification in 185 ml of an aqueous 10% gelatin solution containing 8 ml of a solution of 10% sodium dodecylbenzene-sulfonate.

(*: The structures are shown hereinafter in Example 1).

An emulsion of super fine silver bromide grains having a mean grain size of 0.05 μm was obtained by simultaneously adding an aqueous silver nitrate solution and an aqueous potassium bromide solution to an aqueous gelatin solution with vigorously stirring at 40° C. over a period of 10 minutes. In this case, the aqueous potassium bromide solution was added while controlling the flow rate so that the silver potential to SCE (saturated calomel electrode) became +50 mV.

| Coating Composition | |
|---|---|
| Silver halide | 0.30 $g/m^2$ as Ag |
| Gelatin | 1.86 $g/m^2$ |
| Yellow Coupler (E × Y) | 0.82 $g/m^2$ |
| Color Image Stabilizer (Cpd-1) | 0.19 $g/m^2$ |
| Solvent (Solv-1) | 0.35 $g/m^2$ |

For each of the coated samples, the exposure amount to obtain a density of (maximum density—minimum density)×¾ when developed with the developer described below for 3 minutes at 30° C. was previously determined and after applying a uniform exposure to ecah sample at the exposure amount, the sample was developed with the developer for 10 seconds at 30° C. Thereafter, the development was immediately stopped with an aqueous 5% acetic acid solution. The development time must be set to a proper time according the developing property of the emulsion used and it is preferred to select suitable conditions by changing the developing time and temperature.

Thereafter, the sample was immersed in water at 40° C. containing a gelatin decomposing enzynme, the emulsion layer was separated from the PET film and dispersed in water, oily components such as the coupler, the coupler solvent, etc., were separated and removed, and further the silver halide grains in the middle of the development were deposited by centrifugal separation.

The silver halide grains thus obtained were observed by an electron microscope according to the replica method as is disclosed in Jap. J. Appln. Phys. 8 1377–1389 (1969) and the development initiation points were determined.

| Developer | |
|---|---|
| Triethanolamine | 8 ml |
| N,N—Diethylhydroxylamine (ageous 85% solution) | 5 ml |
| Ethylenediaminetetraacetic Acid $2Na.2H_2O$ | 2.2 g |
| N—Ethyl-N—(β-methanesulfonamidoethyl)-3-methyl-r-aminoanilin Sulfate | 5.0 g |
| Sodium Sulfite | 0.13 g |
| Sodium Chloride | 1.4 g |
| Potassium Hydrogen Carbonate | 5 g |
| Potassium Carbonate | 18 g |
| Water to make | 1,000 ml |
| | pH = 10.10 |

Figure 2:
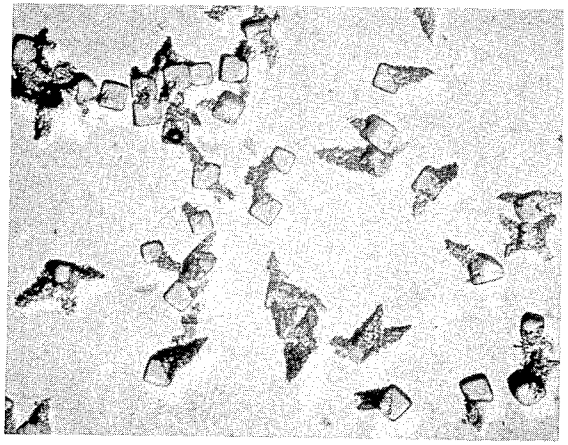
FIG. 2 is an electron microphotograph (5,000 degree of magnification) showing the silver halide crystals of Emulsion (B) used in this invention prepared in Experiment (1) at the beginning of development.

The electron microphotographs of the silver halide crystals obtained using Emulsion A and Emulsion B at the beginning of development are shown in FIG. 1 and FIG. 2, respectively.

The ratio of the corner development type grains (CDG) in the silver halide grains obtained by adding the CR compound, etc., according to this invention was 86%. On the other hand, in the case of Emulsion (A) containing no CR compound, etc., the ratio of the corner development type grains was markedly less as compared to the case of using Emulsion (B).

The following examples serve to illustrate this invention more practically without limiting, however, the scope of the invention. Unless otherwise indicated herein, all parts, percents, ratios and the like are by weight.

EXAMPLE 1

A multilayer color photographic paper having the layer structure shown below on a paper support, both surfaces of which are coated with polyethylene, was prepared.

Each coating solution was prepared by mixing each silver halide emulsion, various chemicals, and an emulsified dispersion of coupler. The preparation methods are shown below.

PREPARATION OF COUPLER EMULSIFIED DISPERSION

In mixture of 27.2 ml of ethyl acetate and 7.7 ml of a solvent (Solv-1) were dissolved 19.1 g of a yellow coupler (ExY) and 4.4 g of a color image stabilizer (Cpd-1) and the solution was dispersed by emulsification in 185 ml of an aqueous 10% gelatin solution containing 8 ml of a solution of 10% sodium dodecylbenzenesulfonate.

In a manner similar to the above, the emulsified dispersion for each of a magenta coupler, a cyan coupler, and an intermediate layer was prepared.

The compounds used for each emulsion were as follows.

(ExY) Yellow Coupler

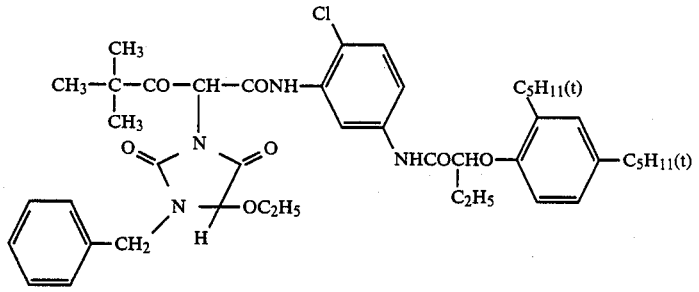

Magenta Coupler (Ex M-1) Same as above M-(1)

(Ex M-2) same as above M-(3)

(Ex M-3)

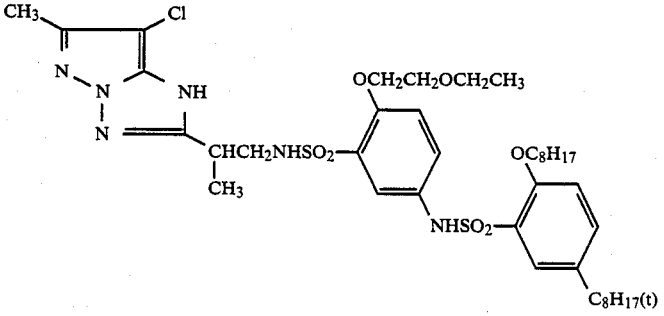

-continued
(Ex M-4)
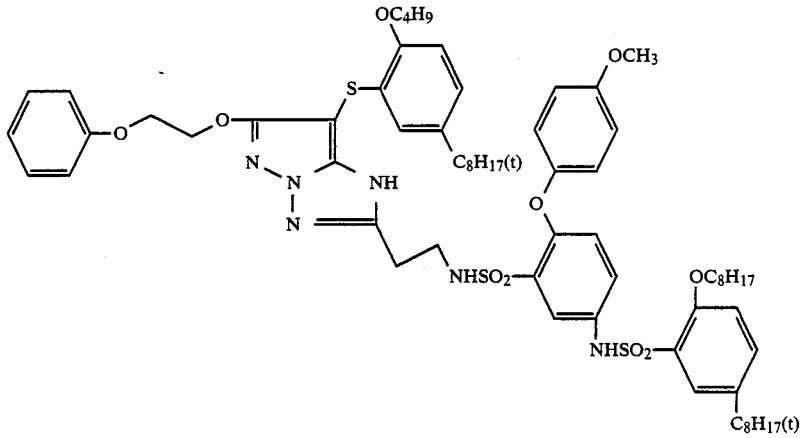
(Ex C-1) Same as above C-(1)
(Ex C2)
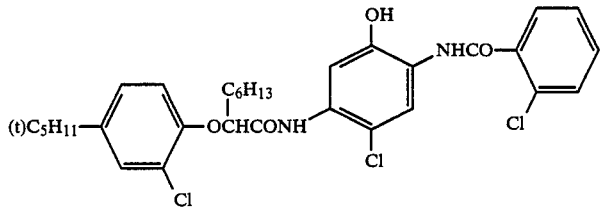
(Ex C3)
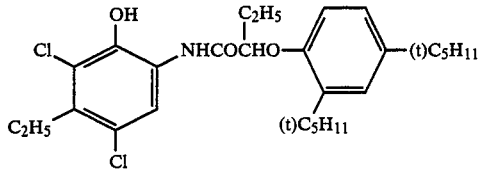
(Ex C4)
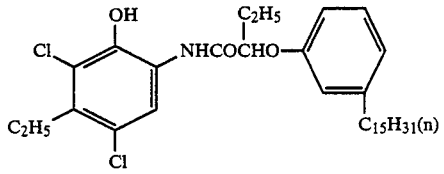
(Ex C5)
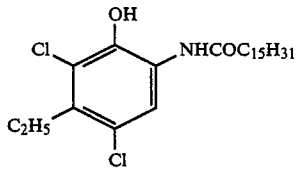
(Cpd-1) Color Image Stabilizer
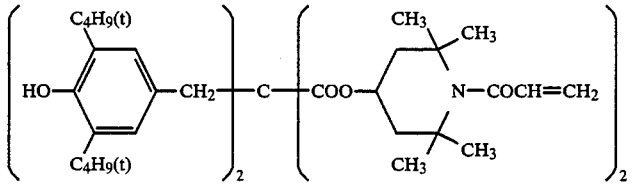
(Cpd-2)
Color Mixing Preventing Agent
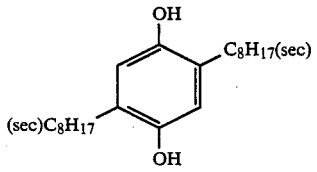

-continued
(Cpd-3) Color image stabilizer
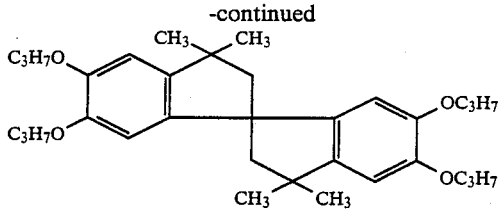
(Cpd-4) Color image stabilizer
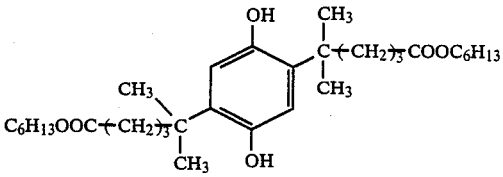
(Cpd-5)
Color Mixing Preventing Agent
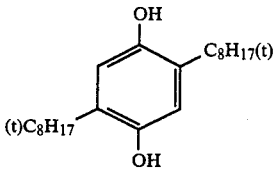
(Cpd-6) Color Image Stabilizer
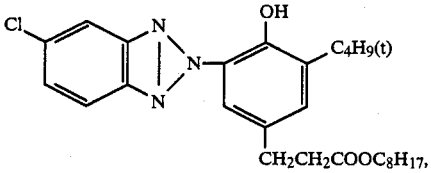
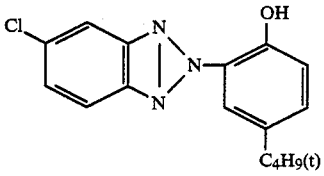
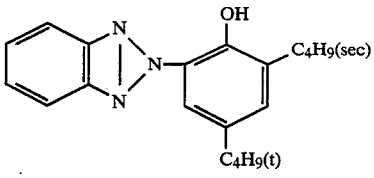
Mixture of 5:8:9 (by weight)
(Cpd-7) Polymer
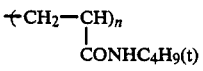
Average Molecular Weight 80,000
(UV-1) Ultraviolet Absorbent
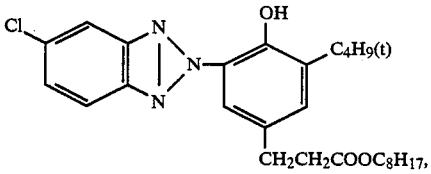
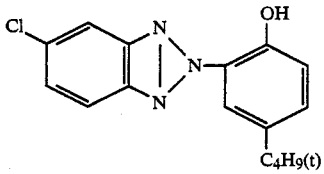

-continued

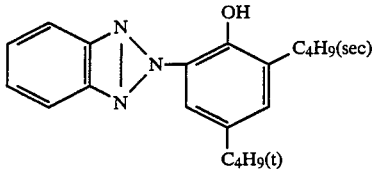

Mixture of 2:9:8 (by weight)

(Solv-1) Solvent

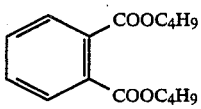

(Solv-2) Solvent

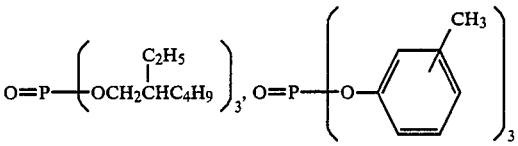

1:1 mixture (volume ratio)

(Solv-3) Solvent $O{=}P{\leftarrow}O{-}C_9H_{19}(iso))_3$ (Solv-4) Solvent

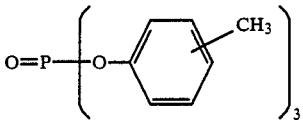

For the blue-sensitive emulsion layer was used a Stabilizer [(XXI)-(7) described above] at $2.5\times10^{-4}$ mol per mol of silver halide.

For each layer was used 1-oxy-3-5-dichloro-s-triazine sodium salt as a hardening agent.

Also, the following dyes were added to the emulsion layers for irradiation prevention.

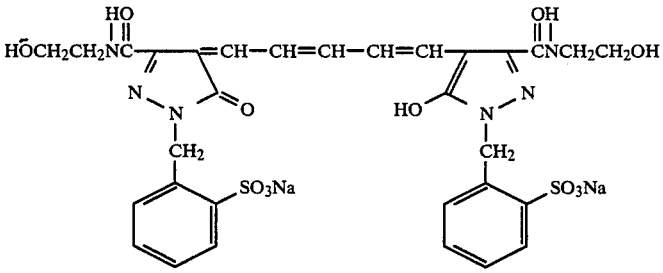

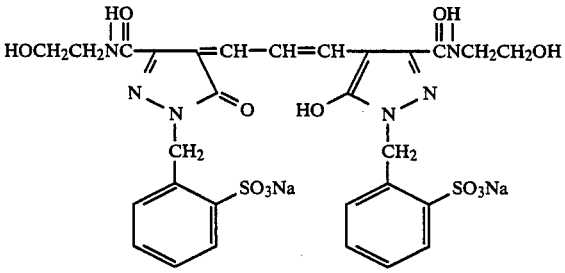

Also, the following compound was added to the red-sensitive emulsion layer at $2.6\times10^{-3}$ mol per mol of silver halide.

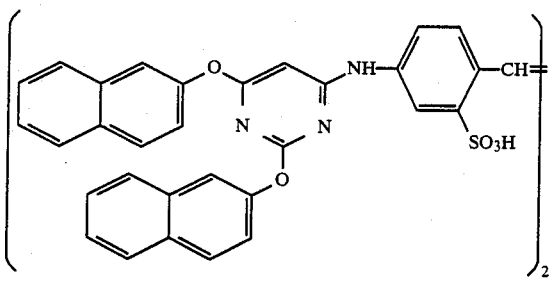

The preparation methods for silver halide emulsions for use in the example are explained below.

For the blue-sensitive emulsion, Emulsion (B) prepared above in Experiment (1) was used as the emulsion of this invention.

Also, Emulsion (A) prepared in Experiment (1) was most suitably chemically sensitized by only adding thereto sodium thiosulfate at 58° C. and after finishing the chemical sensitization, the CR compound (CR-7) was added thereto at $2.6\times10^{-4}$ mol per mol of silver to provide Emulsion I).

Samples 201 and 202 each has the some composition except that blue-sensitive layer of Sample 201 contains Emulsion I and blue-sensitive layer of Sample 202 contains Emulsion B.

TABLE 1

| | Layer 1 | | Layer 3* | | Layer 5 | |
|---|---|---|---|---|---|---|
| Sample | Emulsion | Coupler | Emulsion | Coupler | Emulsion | Coupler |
| 201 | (I) | E × Y | (C) | E × M1 | (J) | Mixture of E × C1 and C2(1:1 by wt) |
| 202 | (B) | E × Y | (H) | E × M1 | (K) | Mixture of E × C1 and C2(1:1 by wt) |

LAYER STRUCTURE

Then, the composition of each layer on Sample 101 was shown below. The numerals show coated amounts in g/m² but shown the coated amount (g/m²) as silver for silver halide emulsion layer.

In addition, the support was a paper support, both surfaces of which were coated with polyethylene wherein titanium dioxide as white pigment and blue dye (ultramarine) were contained in polyethylene having the first layer thereon. The hardening agent used in each layer was sodium 1-oxy-3,5-dichloro-s-triazine.

| | |
|---|---|
| Layer 1 (Blue-Sensitive Layer) | |
| Silver Halide Emulsion | 0.30 |
| Gelatin | 1.86 |
| Yellow Coupler (E × Y) | 0.82 |
| Color Image Stabilizer (Cpd - 1) | 0.19 |
| Solvent (Solv - 1) | 0.35 |
| Layer 2 (Color mixing Preventing Layer) | |
| Gelatin | 0.99 |
| Color Mixing Preventor (Cpd - 2) | 0.08 |
| Layer 3 (Green-Sensitive Layer) | |
| Silver Chlorobromide Emulsion | 0.36 |
| Gelatin | 1.24 |
| Magenta Coupler E × M - 1) | 0.31 |
| Color Image Stabilizer (Cpd - 3) | 0.25 |
| Color Image Stabilizer (Cpd - 4) | 0.12 |
| Solvent (Solv - 2) | 0.42 |
| Layer 4 (Ultraviolet Absorptive Layer) | |
| Gelatin | 1.58 |
| Ultraviolet Absrorbent (UV - 1) | 0.62 |

-continued

| | |
|---|---|
| Color Mixing Preventor (Cpd - 5) | 0.05 |
| Solvent (Solv - 3) | 0.24 |
| Layer 5 (Red-Sensitive Layer) | |
| Silver Chlorobromide Emulsion | 0.23 |
| Gelatin | 1.34 |
| Cyan Couplers (blend of E × C - 1 and E × C - 2 at 1:1) | 0.34 |
| Color Image Stabilizer (Cpd - 6) | 0.17 |
| Polymer (Cpd - 7) | 0.40 |
| Solvent (Solv - 4) | 0.23 |
| Layer 6 (Ultraviolet Absorptive Layer) | |
| Gelatin | 0.53 |
| Ultraviolet Absorbent (UV - 1) | 0.21 |
| Solvent (Solv - 3) | 0.08 |
| Layer 7 (Protective Layer) | |
| Gelatin | 1.33 |
| Acryl-Modified Copolymer of Polyvinyl Alcohol (modified degree 17%) | 0.17 |
| Liquid Paraffin | 0.03 |

Each of the coated sample 201 to 202 thus prepared was exposed and processed according to the following processings and then the sensitivities of each of the blue sensitive layers was compared. The results obtained are shown in Table 2 below.

EXPOSURE

Each sample was subjected to a sensitometric gradation exposure through a green filter using an actinometer (FWF type, made by Fuji Photo Film Co., Ltd., color temperature of light source 3200° K.). The light exposure in this case was applied at an exposure tome of 1.10 sec. and at an exposure amount of 250 CMS.

Thereafter, the samples thus exposed were processed as follows.

| Processing Step | Temperature | Time |
|---|---|---|
| Color development | 35° C. | 45 sec. |
| Blix | 35° C. | 45 sec. |
| Wash | 28 to 35° C. | 90 sec. |

The compositions of the processing solutions were as follows.

| | |
|---|---|
| Color Developer | |
| Triethanolamine | 8.12 g |
| N,N—Diethylhydroxylamine | 4.93 g |
| Optical Whitening agent, UVITEX CK (trade name, made by Ciba-Geigy Corporation) | 2.80 g |
| 4-Amino-3-methyl-N—ethyl-N—[β-(methanesulfonamido)ethyl]-p-phenylenediamine Sulfate | 4.96 g |
| Sodium Sulfite | 0.13 g |
| Potassium Carbonate | 18.40 g |
| Potassium Hydrogencarbonate | 4.85 g |
| EDTA.2Na.2H$_2$O | 2.20 g |
| Sodium Chloride | 1.36 g |
| Water to make | 1,000 ml |
| | pH 10.05 |
| Blix Soluion | |
| Ammonium Thiosulfate (54 wt. %) | 103.0 ml |
| NH$_4$ [EDTA.Fe] | 54.10 g |
| EDTA.2Na.2H$_2$O | 3.41 g |
| Sodium Sulfite | 16.71 g |
| Glacial Acetic Acid | 8.61 g |
| Water to make | 1,000 ml |
| | pH 5.44 |

TABLE 2

| | Layer | Green sensitive Layer | Red-sensitive Layer | Remarks |
|---|---|---|---|---|
| 201 | 100 | 100 | 100 | Comparison |
| 202 | 415 | 401 | 370 | Present Invention |

As is clear from the results shown in Table 2 above, it can be seen that the Sample 202 using the corner development type emulsion B of this invention have very high sensitivity as compared with the comparison Sample 201.

When couplers $ExM_2$ $ExM_3$ and $ExM_4$ and couplers $ExC_3$, $ExC_4$ and $ExC_5$ each was used in the Layers 3 and 5, respectively, the same results as in Sample 202 were obtained.

As described above, by using the CDG emulsion of this invention, a very high sensitivity is attained in an intrinsic sensitizing region and a spectral sensitizing region and also the stability is improved.

Furthermore, when high-temperature rapid processing is performed, the formation of fog can be kept low and excellent stability can be obtained.

Moreover, a high contrast emulsion is obtained and since such an emulsion has excellent pressure resistance, the emulsion has the advantage that the occurrence of pressure desensitization is less and the formation of fog at the unexposed portions due to pressure is less.

While the invention has been described in detail and with reference to specific embodiments thereof, it will be apparent to one skilled in the art that various changes and modification can be made therein without departing from the spirit and scope thereof.

What is claimed is:

1. A corner development type silver halide photographic emulsion wherein the silver halide crystals in the silver halide emulsion are cubic or tetradecahedral grains having at least substantial (100) planes and the emulsion is controlled so that at least 70% of developed silver halide crystals (grains), which are observed on applying a light exposure of 1/50 second to the emulsion under the light-exposure condition corresponding to (maximum density—minimum density)$\times\frac{3}{4}$ of the silver image in the characteristic curve of the emulsion obtained by the developer, developing under the development condition which are used for processing a photographic light-sensitive material formed by coating the emulsion on a support, and stopping the development with an aqueous solution of 5% glacial acetic acid just after the initiation of the development, are developed at one or more corners of the cubic or tetradecahedral crystals or at the vicinity of at least one of the corners.

2. The corner development type silver halide photographic emulsion as claimed in claim 1 wherein the silver halide grains compose substantially silver chloride.

3. A corner development type silver halide photographic emulsion as claimed in claim 1, wherein at least one compound selected from the group consisting of cyanine dyes, merocyanine dyes, mercaptoazoles and nucleic acid decomposition products is adsorbed on said (100) planes of the silver halide crystals in the silver halide emulsion.

4. A corner development type silver halide photographic emulsion as claimed in claim 3, wherein bromide ions are supplied to the silver halide emulsion.

5. A corner development type silver halide photographic emulsion as claimed in claim 3, wherein said cyanine dyes or merocyanine dyes are those represented by following formulae (I), (II) or (III).

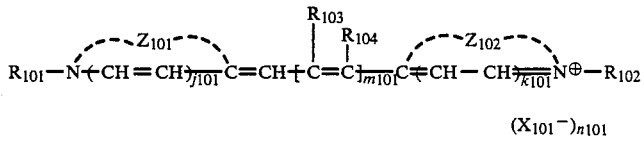

(I)

wherein $Z_{101}$ and $Z_{102}$ each represents an atomic group necessary for forming a heterocyclic nucleus, $R_{101}$ and $R_{102}$ each represents an alkyl group, an alkenyl group, an alkynyl group, or an aralkyl group, $m_{101}$ represents an integer of 1, 2 ot 3, $R_{103}$ represents a hydrogen atom, a lower alkyl group, an aralkyl group, or an aryl group and $R_{104}$ represents a hydrogen atom, when $m_{101}$ is 1, $R_{103}$ represents a hydrogen atom and $R_{104}$ represents a hydrogen atom, a lower alkyl group, or an aralkyl group or combine with $R_{102}$ to form a 5-membered or 6-membered ring, when $m_{101}$ is 2 or 3, $R_{103}$ may combine with the other $R_{103}$ to form a hydrocarbon ring or a heterocyclic ring, $j_{101}$ and $k_{101}$ represent 0 or 1, $X_{101}$ represents an acid anion, and $n_{101}$ represents 0 or 1.

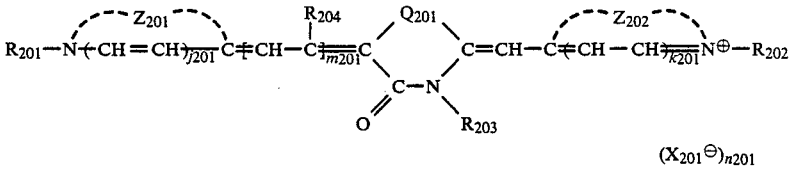

(II)

wherein $Z_{201}$ and $Z_{202}$ have the same significance as $Z_{101}$ or $Z_{102}$, $R_{201}$ and $R_{202}$ have significance as $R_{101}$ or $R_{102}$, $R_{203}$ represents an alkyl group, an alkenyl group, an alkynyl group, or an aryl group (e.g., a substituted or unsubstituted phenyl group), $m_{201}$ represents 0, 1 or 2, $R_{204}$ represents a hydrogen atom, a lower alkyl group, or an aryl group, or $R_{204}$ and $R_{204}$ combine with each other to form a hydrocarbon ring or a heterocyclic ring when $m_{201}$ is 2, $Q_{201}$ represents a sulfur atom, an oxygen atom, a selenium atom or $>N—R_{205}$, wherein $R_{205}$ has the same significance as $R_{203}$ and $j_{201}$, $k_{201}$, $X_{201}^-$, and $n_{201}$ have the same significance as $j_{101}$, $k_{101}$, $X_{101}^-$, and $n_{101}$, respectively, in formula (I).

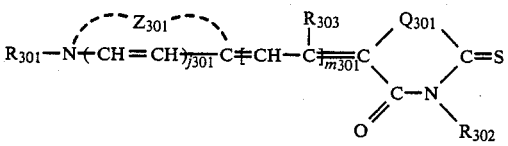

(III)

wherein $Z_{301}$ represents an atomic group necessary for forming a heterocyclic ring. $Q_{301}$ has the same significance as $Q_{201}$ in formula (II), $R_{301}$ has the same significance as $R_{101}$ or $R_{102}$ in in formula (I), and $R_{302}$ has the same significance as $R_{203}$ in formula (II), $R_{303}$ has the same significance as $R_{204}$ in formula (II), or when $m_{301}$ is 2 or 3, $R_{303}$ may combine with other $R_{303}$ to form a hydrocarbon ring or a heterocyclic ring, $j_{301}$ has the same significance as $j_{101}$ in formula (I).

6. A corner development type silver halide photographic emulsion as claimed in claim 3, wherein said compound is used in an amount of $10^{-6}$ to $10^{-2}$ mol% per mol of the host silver halide.

7. The corner development type silver halide photographic emulsion as claimed in claim 2, wherein the mean silver bromide content at the surface of the silver halide grains is about 10 mol% or less.

8. The corner development type silver halide photographic emulsion as claimed in claim 1, wherein the ratio of silver halide crystals developed at the corners of the cubic or tetradecahedral crystals or at the vicinity of the corners is at least 80 wt%.

9. The corner development type silver halide photographic emulsion as claimed in claim 1, wherein the silver halide emulsion further contains a color coupler.

10. The corner development type silver halide photographic emulsion as claimed in claim 1, wherein the mean grain size of the silver halide grains is from 0.2 to 2 μm and the grain size distribution is monodisperse.

11. The corner development type silver halide photographic emulsion as claimed in claim 8, wherein the mean grain size of the silver halide grains is from 0.2 to 2 μm and the grain size distribution is monodisperse.

12. The corner development type silver halide photographic emulsion as claimed in claim 1, wherein the crystal form of the host silver halide grains is a cubic or a tetradecahedron.

13. The corner development type silver halide photographic emulsion as claimed in claim 1, wherein the addition amount of the fine silver halide grains is from 0.2 mol% to 20 mol% to the amount of silver of the total amount of the host grains.

* * * * *